US005765087A

United States Patent [19]

Yano et al.

[11] Patent Number: 5,765,087

[45] Date of Patent: Jun. 9, 1998

[54] COLOR IMAGE FORMING METHOD AND COLOR IMAGE FORMING APPARATUS PRACTICABLE THEREWITH

[75] Inventors: Hidetoshi Yano, Yokohama; Yasushi Nakazato, Tokyo; Takayuki Kimura, Yokohama; Masako Yoshii, Kawasaki; Hiroyasu Itou, Tokyo, all of Japan

[73] Assignee: Ricoh Company, Ltd., Tokyo, Japan

[21] Appl. No.: 778,723

[22] Filed: Dec. 27, 1996

[30] Foreign Application Priority Data

Dec. 28, 1995 [JP] Japan ..... 7-353109
Jun. 1, 1996 [JP] Japan ..... 8-160781

[51] Int. Cl.[6] ..... G03G 15/01

[52] U.S. Cl. ..... 399/344; 399/358

[58] Field of Search ..... 399/344, 358, 399/359, 149

[56] References Cited

U.S. PATENT DOCUMENTS 4,772,253 9/1988 Koizumi et al. .
5,235,384 8/1993 Oka et al. .
5,260,754 11/1993 Yano et al. .
5,606,408 2/1997 Yano et al. .
5,619,316 4/1997 Shoji et al. ..... 399/359
5,638,159 6/1997 Kai et al. .

FOREIGN PATENT DOCUMENTS 54-24640 2/1979 Japan .
61-196268 8/1986 Japan .
2-262180 10/1990 Japan .

*Primary Examiner*—S. Lee
*Attorney, Agent, or Firm*—Oblon, Spivak, McClelland, Maier & Neustadt, P.C.

[57] ABSTRACT

The color image forming method of the kind sequentially forming toner images of different colors on an image carrier with developers of corresponding colors stored in a plurality of developing devices, sequentially transferring the toner images to a single paper or similar recording medium one above the other, and returning the toner left on the image carrier after the image transfer to the developing devices color by color, and an image forming apparatus practicable therewith. After the transfer of a toner image of any particular color to the paper wrapped around a transfer drum, a cleaning roller assigned to the above color each collects the toner remaining on the drum and again deposits it on the drum. The drum conveys the redeposited toner to one of the developing devices storing a developer of the same color as the toner.

20 Claims, 13 Drawing Sheets

ME3
ME4
CE3
CE4
BE3
BE4
YE3
YE4
YE2
YE5
ME2
ME5
CE2
CE5
BE2
BE5
S1
E1
Q
P
20
12
6
7
8
10B
10C
10M
10Y
14
13
15
11
2
3
L
T1
T
A
B
I
4Y
5Y
9Y
YD
4M
5M
MD
9M
4C
5C
9C
CD
4B
5B
9B
BD

COLOR IMAGE FORMING METHOD AND COLOR IMAGE FORMING APPARATUS PRACTICABLE THEREWITH

BACKGROUND OF THE INVENTION

The present invention relates to a color image forming method for sequentially forming toner images on a rotary image carrier with toner of different colors stored in a plurality of developing units, sequentially transferring the toner images to a single recording medium one above the other, and cleaning, after the transfer of each toner image, the image carrier by collecting the toner remaining thereon with a rotary cleaning member, and an image forming apparatus practicable therewith.

In a copier, printer, facsimile apparatus, multiplex apparatus thereof or similar color image forming apparatus practicable with a method of the kind described, toner remains on an image carrier every time a toner image is transferred from an image carrier to a recording medium. The toner remaining on the image carrier must be collected by a cleaning member each time in order to clean the surface of the image carrier. While a cleaning device for cleaning the image carrier has been proposed in various forms in the past, a predominant cleaning device has been so constructed as to store the toner collected from the image carrier in, e.g., a disposable waste toner tank.

Today, there is an increasing demand for an electrophotographic image forming apparatus of the type described and capable of further reducing the amount of toner to be discarded in order to promote cost reduction and protection of environment. For this purpose, use may be made of a so-called cleanerless image forming system which allows a 100% of toner to be transferred from the image carrier to the recording medium, i.e., allows no toner to remain on the image carrier after image transfer. This kind of system not only eliminates the toner to be discarded but also eliminates the need for a cleaning device. Consequently, the image forming system is simplified while the cost of the image forming apparatus is reduced. However, with the state-of-the-art system, it is difficult to implement a 100% toner transfer ratio % or to realize reliable cleaning.

The second best measure is disclosed in, e.g., Japanese Patent Publication No. 61-30274. A method disclosed in this document uses a cleaning member capable of electrostatically collecting toner remaining on the image carrier after image transfer. The toner collected by the cleaning member is electrostatically returned to, or redeposited on, the portion of the surface of the image carrier which will not effect the formation of a toner image. Then, the redeposited toner is conveyed by the image carrier to a developing device and electrostatically collected and reused by the developing device. This method eliminates the need for a waste toner tank for storing the collected toner or exclusive means for conveying the collected toner to the developing device. Therefore, such a method reduces the cost of the apparatus and eliminates the toner to be discarded.

In a color image forming method of the kind stated earlier, the toner images of different colors are sequentially formed on the image carrier while the toner left on the image carrier after image transfer is collected by the cleaning member each time. Assume that the toner redeposition scheme stated above is applied to the color image forming method. Then, the toner of different colors are collected by the cleaning member while being mixed together. If the mixed toner is redeposited on the image carrier and collected by the developing device, then it will be introduced into a developer stored in the developing unit. With such a developer, it is impossible to form a toner image of desired color on the image carrier.

As stated above, the method redepositing the toner collected by the cleaning member and allowing it to be reused in the developing device is not applicable to a color image forming apparatus although it simplifies an image forming apparatus and promotes the reuse of toner.

SUMMARY OF THE INVENTION

It is therefore an object of the present invention to provide a color image forming method capable of collecting toner left or an image carrier with a cleaning member, redepositing the collected toner on the image carrier, and collecting the redeposited toner in a developing device, and an image forming apparatus practicable therewith.

In accordance with the present invention, a color image forming method includes the step of sequentially forming toner images of different colors on an image carrier in rotation by a plurality of developing devices each storing a developer of particular color. The toner images are sequentially transferred to a single recording medium one above the other. After each of the toner images has been transferred to the recording medium, toner left on the image carrier is electrostatically collected by by respective one of a plurality of cleaning members. Each of the toner of different colors collected by the cleaning members is redeposited on a particular surface portion of the image carrier which will not effect the formation of a toner image. Each of the toner of different colors redeposited on the image carrier is electrostatically collected by a particular developing device.

Also, in accordance with the present invention, a color image forming method includes the step of sequentially forming toner images of different colors on an image carrier in rotation by a plurality of developing devices each storing a developer of particular color. The toner images are sequentially transferred to a single recording medium one above the other. After each of the toner images has been transferred to the recording medium, toner left on the image carrier is electrostatically collected by by respective one of a plurality of toner collecting regions sequentially formed on the surface of a single cleaning member in the circumferential direction of the cleaning member.

Each of the toner of different colors collected by the respective toner collecting region is redeposited on a particular surface portion of the image carrier which will not effect formation of a toner image. Each of the toner of different colors redeposited on the image carrier is electrostatically collected by a particular developing device.

BRIEF DESCRIPTION OF THE DRAWINGS

The above and other objects, features and advantages of the present invention will become apparent from the following detailed description taken with the accompanying drawings in which.

In the figures, identical reference numerals denote identical structural elements.

DESCRIPTION OF THE PREFERRED EMBODIMENTS

Figure 1:
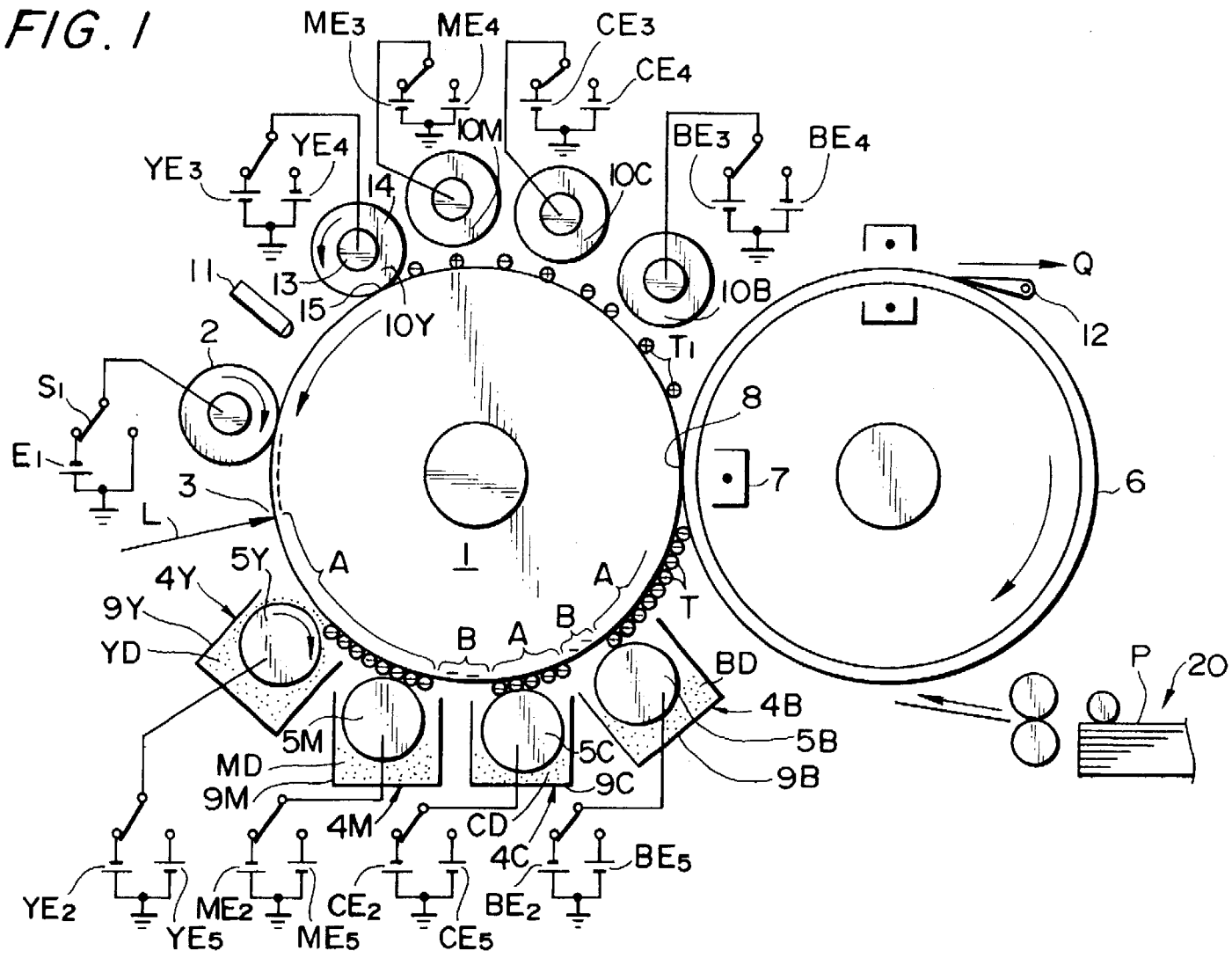
FIG. 1 is a color image forming apparatus embodying the present invention.

Referring to FIG. 1 of the drawings, a color image forming apparatus embodying the present invention is shown and includes a photoconductive element in the form of a drum 1. The drum 1 is rotated in a preselected direction (counterclockwise in the embodiment) by a drive source, not shown. A main charger implemented as a charge roller 2 charges the surface of the drum 1 uniformly to a preselected polarity. In the illustrative embodiment, the charge roller 2 is connected to a voltage source $E_1$ and charges the drum 1 to the negative polarity, i.e., −850 V in contact with the drum 1. The charge roller 2 may be replaced with a corona discharger which does not contact the drum 1, if desired.

In an exposing section 3, a modulated laser beam L, for example, scans the charged surface of the drum 1 in order to form an electrostatic latent image thereon. Let the first latent image be one for a yellow toner image by way of example. The surface potential of the drum 1 is, e.g., about 150 V in an area A scanned by the laser beam L or is maintained at −850 V at an area B nor scanned, i.e., background. The charge roller 2 and exposing device constitute latent image forming means in combination.

A plurality of developing devices or units 4Y, 4M, 4C and 4B are sequentially arranged downstream of the exposing section 3 with respect to the direction of rotation of the drum 1. Letters Y, M, C and B stand for yellow, magenta, cyan and black, respectively. The developing units 4Y–4B each faces the surface of the drum 1. It is to be noted that the number of developing units is equal to the number of colors of toner images to be formed on the drum 1. The developing units 4Y–4B respectively have casings 9Y, 9M, 9C and 9B which store a yellow developer YD, a magenta developer MD, a cyan developer CD, and a black developer BD, respectively. In the illustrative embodiment, the developer consists of toner and carrier although it may be consist only of toner.

The developing units 4Y–4B respectively include developing rollers 5Y, 5M, 5C and 5B facing the drum 1 and which are a specific form of developer conveying members. While one of the developing units 4Y–4B is in operation, the others are held inoperative.

In any one of the developing units 4Y—4D which is in operation, the developing roller is rotated to convey the developer deposited thereon to a developing position where the roller faces the drum 1. The other or inoperative developing units are spaced from the drum 1 or held in a condition wherein their developing rollers do not convey the toner, i.e., the toner is absent at their developing positions.

In each of the developing units 4Y–4B, the toner is charged to a preselected polarity by friction acting between it and the carrier. In the illustrative embodiment, the toner is charged to the same polarity as the drum 1, i.e., negative polarity.

The first developing unit 4Y develops the first latent image with the yellow developer YD and thereby produces a yellow or Y toner image. Specifically, when the first latent image is conveyed via the developing unit 41 by the drum 1, the developing roller 5Y brings the developer YD to the developing position assigned to the unit 4Y. At this instant, a power source $YE_2$ applies a bias voltage of the same polarity as the drum 1, e.g., −600 V to the developing roller 5Y. As a result, the Y toner of the developer YD is electrostatically transferred from the roller 5Y to the latent image, i.e., the area A of the drum 1. In FIG. 1, toner particles T forming the Y toner image are represented by circles. In this manner, the embodiment uses a negative-to-positive or so-called reversal developing system.

In the above condition, because the other developing units 4M, 4C and 4B are inoperative, their toner do not deposit on the drum 1. In addition, the toner of the Y toner image is prevented from being introduced into the developing units 4M, 4C and 4B.

A transfer drum 6 is located downstream of the developing devices 4Y–4B in the direction of rotation of the drum 1, and faces the surface of the drum 1. The transfer drum 6 is rotated clockwise, as viewed in FIG. 1. A paper or similar recording medium P is fed from a paper feed device 20 and wrapped around the transfer drum 6. A clamp, not shown, is provided on the transfer drum 6 in order to clamp the leading edge of the paper P.

The drum 1 and transfer drum 6 face each other at an image transfer position 8. A transfer charger 7 is disposed in the transfer drum 6. When the Y toner image arrives at the image transfer position 8, the transfer charger 7 transfers the Y toner image from the drum 1 to the paper P contacting the drum 1. Specifically, a charge wire included in the transfer charger 7 electrostatically attracts the toner away from the drum 1 by discharge. As a result, the toner image is transferred from the drum 1 to the paper P.

After the image transfer, toner particles $T_1$ are left on the drum 1 without being transferred to the paper P, as also represented by circles in FIG. 1. A cleaning rollers or cleaning members 10Y, 10M and 10C and 10B are sequentially arranged in the direction of rotation of the drum 1. Among them, the first cleaning roller 10Y collects the remaining toner particles $T_1$ from the drum 1 at a cleaning position 15 assigned thereto, thereby cleaning the drum 1. A discharge lamp 11 discharges the cleaned surface of the drum 1 so as to restore it to the reference surface potential.

The cleaning rollers 10Y–10B are mounted on the body of the apparatus such that they are individually movable between an operative position contacting the drum 1 and an inoperative position spaced from the drum 1. While one of the cleaning rollers 10Y–10B is in its operative position, the others are held in their inoperative positions.

FIG. 1 specifically shows a condition wherein the first cleaning roller 10Y is rotating in contact with the drum 1 while the other rollers 10M, 10C and 10B are spaced from the drum 1. The toner collected by the cleaning roller 10Y is again deposited on the drum 1 and then collected in the developing unit 4Y, as will be described in detail later.

After the transfer of the Y toner image to the paper P, a second latent image for a magenta or M toner image is formed in the discharged portion of the drum 1 by the charge roller 2 and laser beam L in exactly the same manner as the first latent image. The second latent image is developed by the second developing unit 4M which is operative at this time, turning out an M toner image. At this instant, the other developing units 4Y, 4C and 4B are held inoperative.

The M toner image is transferred to the paper P clamped on the transfer drum 6 over the Y toner image existing on the paper P.

The second cleaning roller 10M now rotating in contact with the drum 1 collects the M toner remaining on the drum 1 after the above image transfer. At this instant, the other cleaning rollers 10Y, 10C and 10B are held in their inoperative positions spaced from the drum 1. The M toner collected by the cleaning roller 10M is also returned to the drum 1 and then collected in the second developing unit M. The discharge lamp 11 discharges the portion of the drum 1 cleaned by the cleaning roller 10M.

Subsequently, a third latent image is formed on the drum 1, developed by the third developing unit 4C to turn out a cyan or C toner image, and then transferred to the paper P roller 10C collects the M toner left on the drum 1 after the image transfer. Then, the discharge lamp 11 discharges the drum 1 cleaned by the cleaning roller 10C. The toner collected by the cleaning roller 10C is also returned to the drum 1 and then collected by the third developing unit 4C.

Finally, a fourth latent image is formed on the drum 1, developed by the fourth developing unit 4B to turn out a black or B toner image, and then transferred to the paper P over the existing composite toner image. The fourth cleaning roller 10B collects the B toner remaintin on the drum 1 after the image transfer. The toner collected by the cleaning roller 10B is also returned to the drum 1 and then collected by the fourth developing unit 4B.

By the above procedure, a composite color image or fullcolor image is formed on the paper P clamped on the drum 6. After the paper P has been unclamped, it is separated from the drum 6 by a separator 12 in a direction Q and then conveyed to a fixing unit, not shown. The fixing unit fixes the full-color toner image on the paper with heat and pressure. Subsequently, the paper or full-color copy is driven out of the apparatus to a tray, not shown.

The construction and operation of the cleaning rollers 10Y–10B will be described more specifically. Because the rollers 10Y–10B are identical in configuration and function, let the following description concentrate on the roller 10Y by way of example. The roller 10Y is made up of a shaft 13 formed of, e.g., conductive metal and an elastic body 14 formed of a foam material, solid rubber or similar material having a medium resistance. The elastic body 14 surrounds the shaft 13. The roller 10Y is received in a casing, not shown, and journalled to opposite side walls of the casing. The roller 10Y as well as the other rollers extends parallel to the drum 1.

The Y toner image, for example, is conveyed from the developing position assigned to the developing unit 4Y to the image transfer position 8. At this instant, most of the yellow toner particles T are of negative polarity deposited at the time of development. On the other hand, the transfer charger 7 charges the toner particles T to the positive polarity opposite to the polarity assigned to development. As a result, the toner particles $T_1$ remaining on the drum 1 after the image transfer are partly positive and partly negative in polarity. In this condition, the toner particles $T_1$ are conveyed to the cleaning section 15 assigned to the cleaning roller 10Y.

Figure 2:
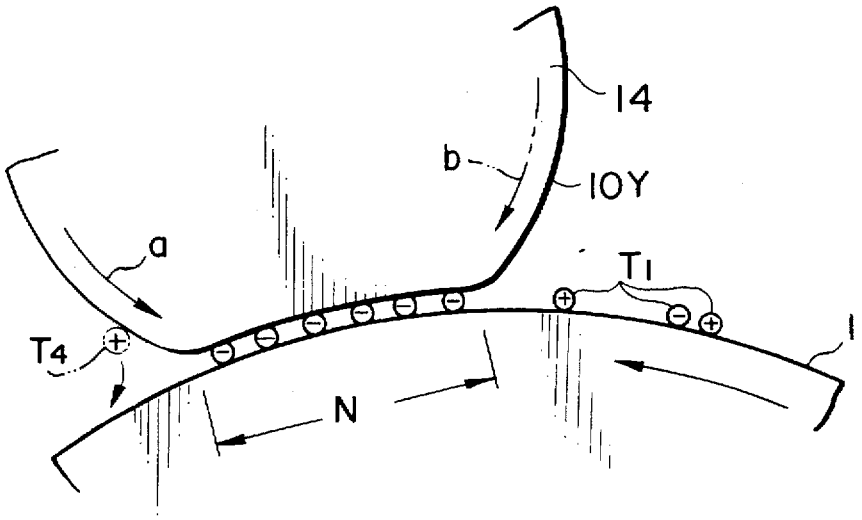
FIG. 2 is an enlarged sketch showing a nip between a photoconductive element and a cleaning roller included in the embodiment and toner particles.

The cleaning roller 10Y in its operative position rotates counterclockwise, as viewed in FIG. 1, so that its surface contacting the surface of the drum 1 moves in opposite direction to the surface of the drum 1. Therefore, the roller 10Y rotates while rubbing itself against the drum 1. The roller 10Y is pressed against the drum 1 such that its elastic body 14 is deformed by the drum 1. As a result, as shown in FIG. 2, a nip N is formed between the roller 10Y and the drum 1 and defines the cleaning position. While the actual nip N is only 1 mm wide or so in the circumferential direction of the drum 1, it is exaggerated in FIG. 2. At the nip N, the positive and negative toner particles $T_1$ are regulated to the polarity assigned to the development (negative in the embodiment) by friction acting between the roller 10Y and the drum 1.

Referring again to FIG. 1, when the roller 10Y collects the toner particles $T_1$ from the drum 1, a voltage source $YE_3$ applies to the shaft 13 of the roller 10Y a voltage opposite in polarity to the toner charged by the roller 10Y, e.g., +200 V. As a result, the toner particles $T_1$ are electrostatically deposited on the roller 10Y and collected thereby. More specifically, the potential of the drum 1 moved away from the transfer charger 7 is, e.g., zero or about −50 V due to the influence of the discharge. However, the toner particles $T_1$ of negative polarity are electrostatically deposited on the roller 10Y due to the difference in potential between the roller 10Y applied with +20 V and the surface of the drum 1.

A reference will be made to FIGS. 3–10, for describing a specific operation for causing the toner particles $T_1$ to be collected by the roller 10Y, then returned to the drum 1, and then collected by the developing unit 4Y. In FIGS. 3–10, the toner collected by the roller 10Y is labeled $T_2$ while the toner redeposited on the drum 1 is labeled $T_3$. The toner particles on the drum 1 or those on the roller 10Y are schematically shown in an enlarged view. Signs "+" and "−" added to the charge roller 2, developing roller 5Y and cleaning roller 10Y are representative of the polarities of voltages applied thereto. This is also true with FIG. 1.

Figure 3:
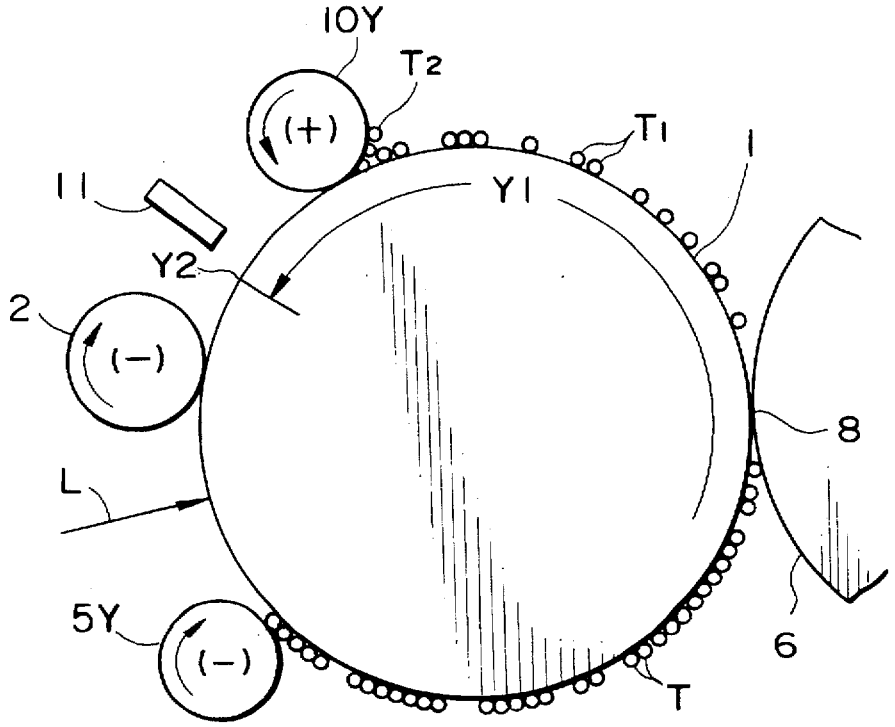
FIGS. 3–10 each shows various members included in the embodiment at a particular stage of operation.

The surface of the drum 1 cleaned by the roller 10Y is discharged by the discharge lamp 11, as shown in FIG. 3. As a result, the surface potential of the drum 1 is lowered to its reference value. The lamp 11 is continuously turned on during image formation. The discharged surface of the drum 1 is again uniformly charged by the charge roller 2 for the next image formation.

While the drum 1 performs several consecutive rotations with the above procedure being effected, a single yellow toner image is formed on the drum 1. The yellow toner image is transferred to the paper clamped on the transfer drum 6. The area of the drum 1 in the circumferential direction where the toner image is formed will be referred to as an image forming area. In FIG. 3, the image forming area is labeled Y1. The leading edge of the area Y1 in the direction of rotation of the drum 1, i.e., the downstream edge of the area Y1 in the above direction is labeled Y2. Likewise, in FIG. 4, the trailing edge or upstream edge of the area Y1 in the above direction is labeled Y3.

Figure 6:
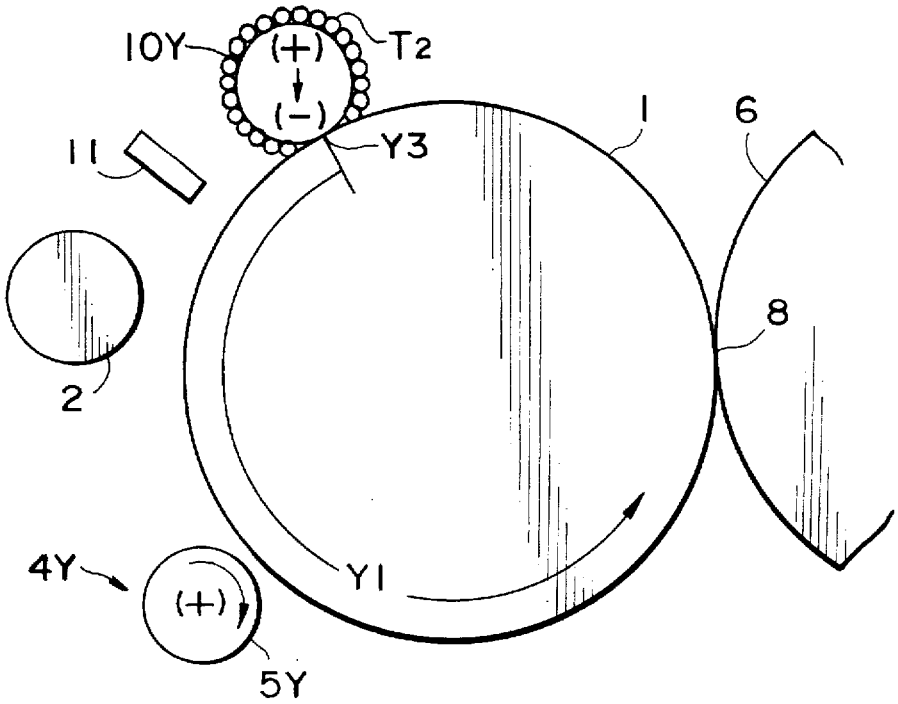

When the leading edge Y2 of the image forming area Y1 reaches the roller 10Y, i.e., just before it reaches the position shown in FIG. 3, the operation for causing the roller 10Y to collect the residual toner particles $T_1$ begins. In the illustrative embodiment, the collection continues until the trailing edge Y3 of the area Y1 reaches the roller 10Y, as shown in FIG. 6.

Figure 4:
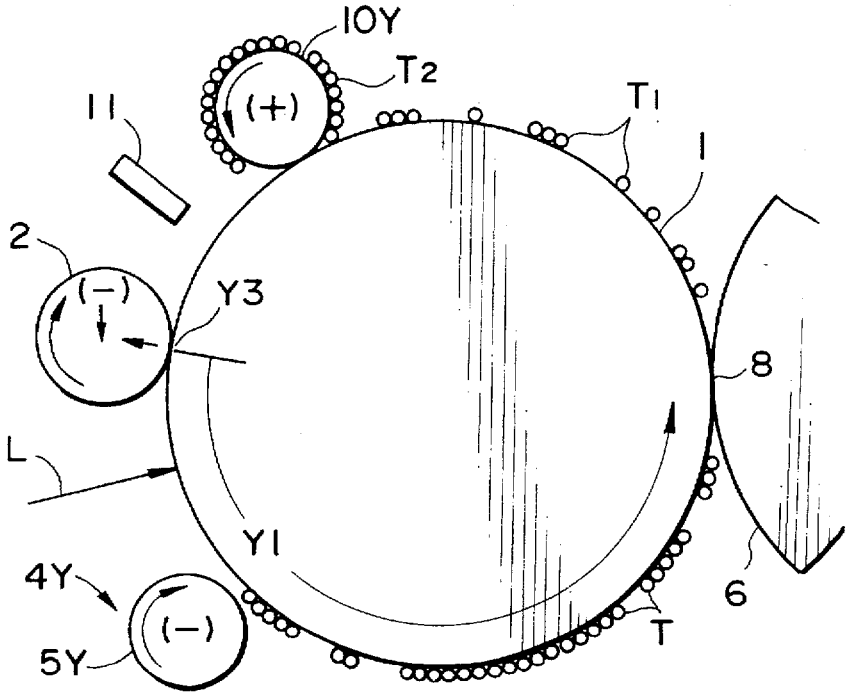
Figure 5:
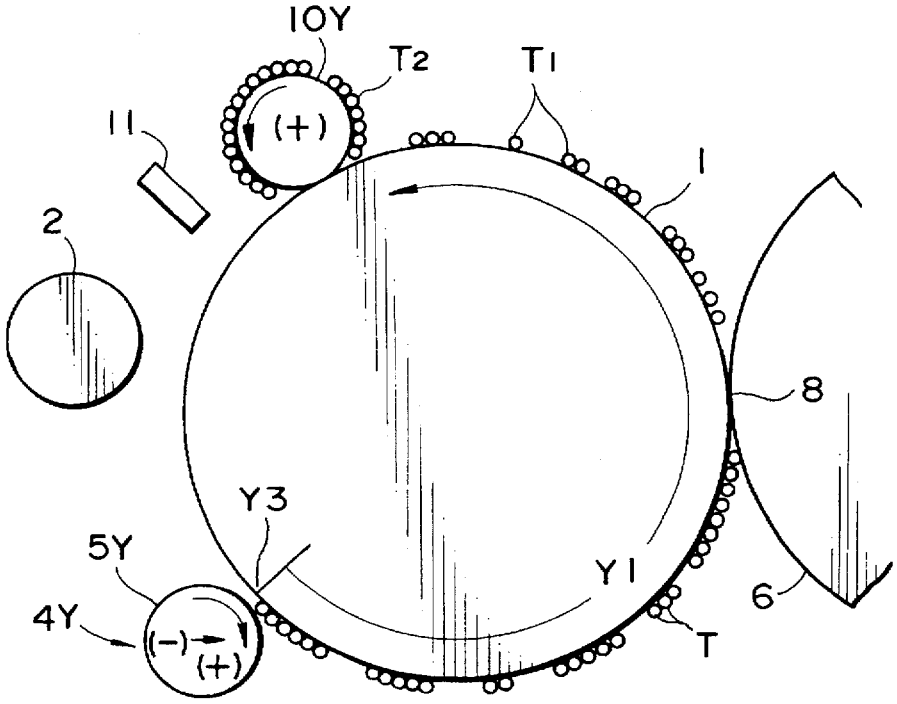

After the roller 10Y has electrostatically removed the toner particles $T_1$ from the drum 1, it electrostatically redeposits the particles $T_2$ in the portion of the surface of the drum 1 which will effect the formation of a latent image. Specifically, assume that the trailing edge Y3 of the image forming area Y1 has moved away from the charge roller 2, as shown in FIG. 4. Then, the charge roller 2 is released from the surface of the drum 1, as shown in FIG. 5. At the same time, a switch $S_1$, FIG. 1, is operated to interrupt the application of the voltage to the charge roller 2.

When the trailing edge Y3 of the area Y1 moves away from the developing roller 5Y of the developing unit 4Y, as shown in FIG. 5. a switch assigned to the roller 5Y is operated to connect the roller to the other voltage source $YE_5$. The voltage source YEapplies to the roller 5Y a voltage opposite in polarity to the Y toner, e.g., +500 V, so that the toner is prevented from depositing on the drum 1. When the trailing edge of the area Y1 moves away form the image transfer position 8, the transfer charger 7 is deactivated. When the trailing edge Y3 of the area Y1 arrives at the cleaning position, as shown in FIG. 6, the collection of the toner particles $T_1$, i.e., the cleaning of the drum 1 ends.

Figure 7:
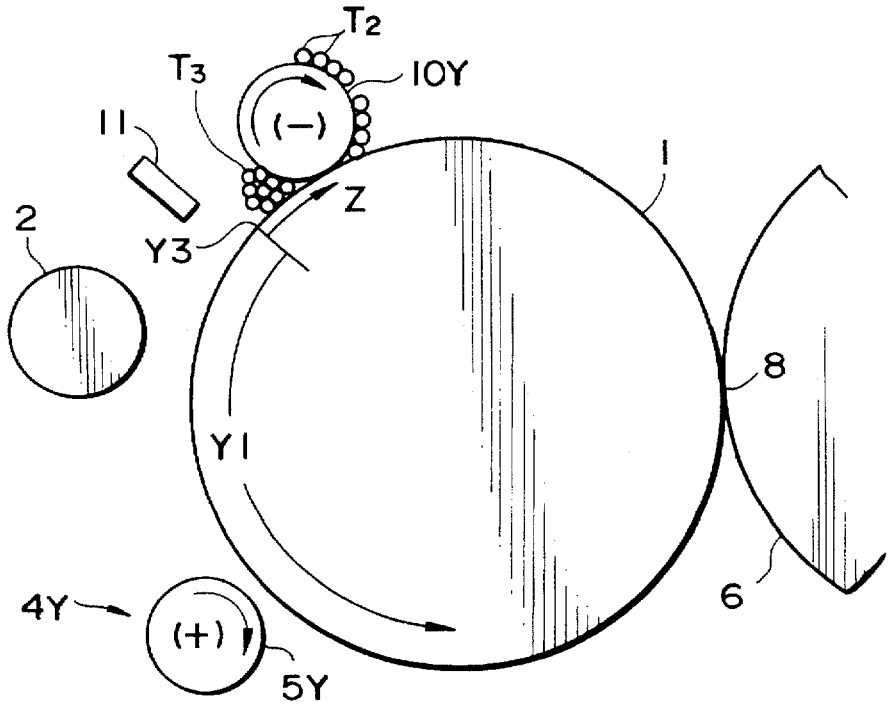
Figure 8:
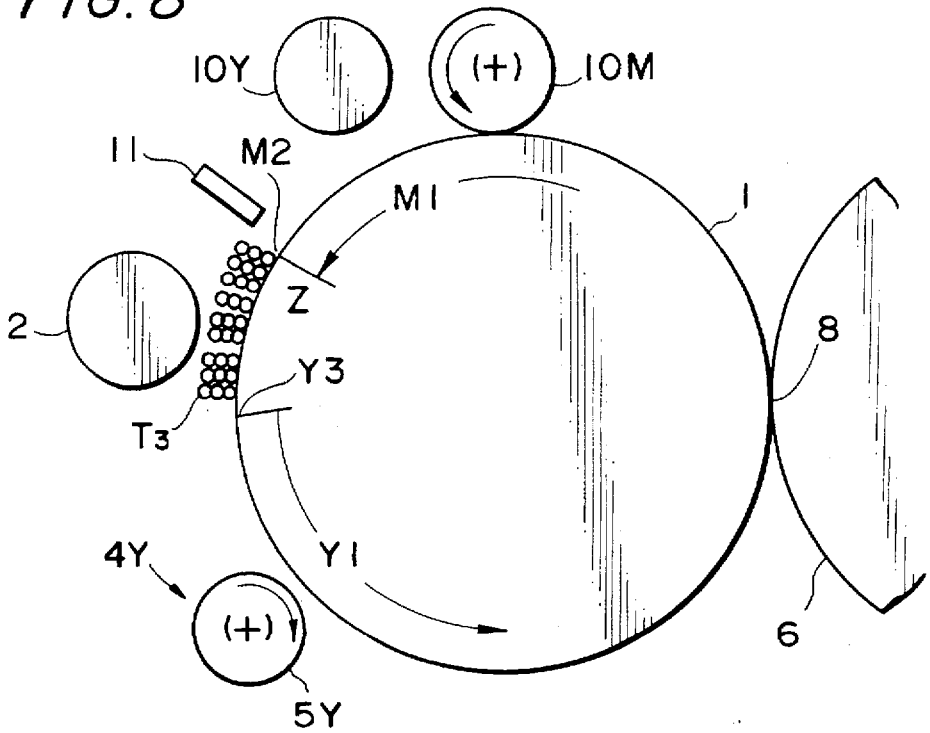
Figure 9:
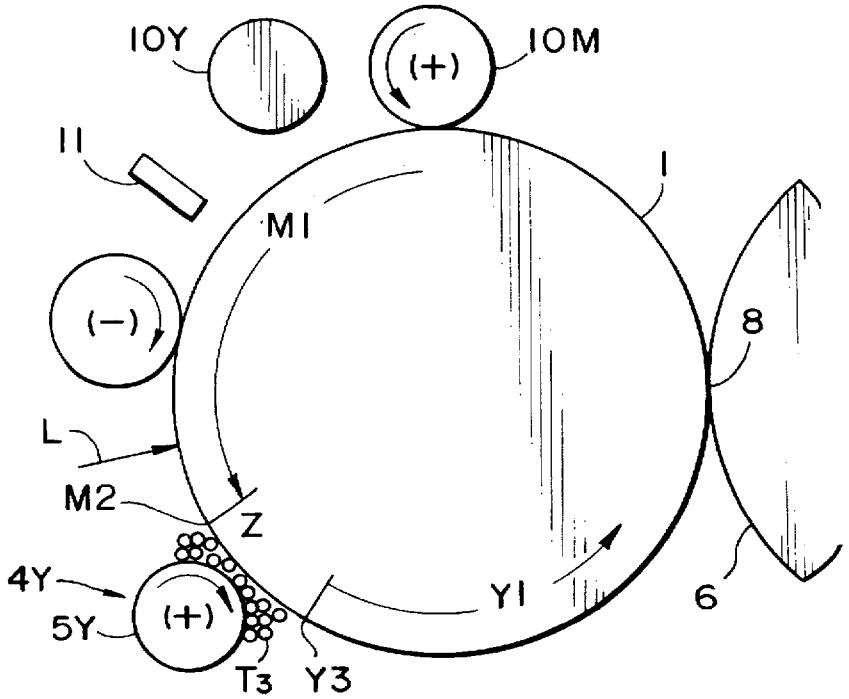
Figure 10:
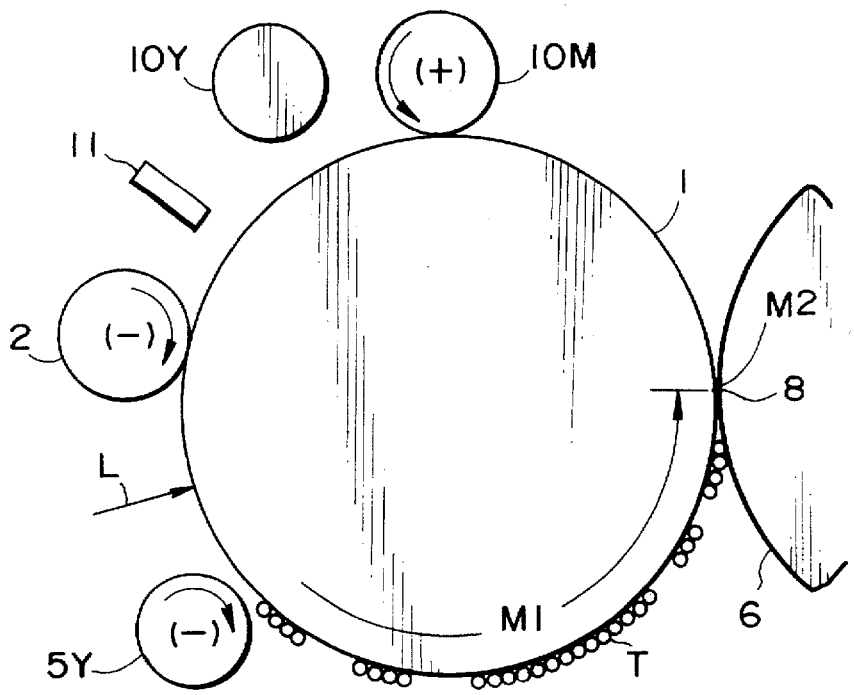

The roller 10Y redeposits the collected toner T2 on the portion of the drum 1 which will not effect the formation of the second latent image for an M toner image, as follows. As shown in FIG. 6, assume that after the transfer of the Y toner image to the paper, the trailing edge Y3 of the image forming area Y1 has moved away from the roller 10Y. Then, a switch assigned to the roller 10Y is operated to connected the roller 10Y to the other voltage source $YE_4$. The voltage source $YE_4$ applies to the shaft 13 of the roller 10Y a voltage of the same polarity as the toner frictionally charged by the roller 10Y, e.g., −3,000 V. As a result, an electric field is formed between the roller 10Y in rotation and the non-image forming area Z (see FIG. 7) of the drum 1 in such a direction that the roller 10Y releases the Y toner $T_2$ onto the drum 1. Consequently, as shown in FIG. 7, the toner $T_2$ is redeposited on the non-image forming area Z of the drum 1. As shown in FIG. 8, the toner $T_3$ returned to the drum 1 is conveyed by the drum 1 via the discharge lamp 11 and charge roller 2 which has been released from the drum 1. When the toner $T_3$ arrives at the developing roller 5Y of the developing unit 4Y, as shown in FIG. 9, the voltage opposite in polarity to the original charge of the toner has been applied to the roller 5Y, as stated earlier. As a result, the toner $T_3$ is electrostatically transferred from the drum 1 to the roller 5Y and collected in the developer YD stored in the developing unit 4Y.

Because the toner $T_3$ collected by the developing unit 4Y is of the same color as the developer YD, it can be reused in the developing unit 4Y without causing any color mixture. This not only obviates the waste of toner but also eliminates the need for a tubing or the like for returning the collected toner to the developing unit.

After the roller 10Y has fully redeposited the collected toner on the drum 1, it is retracted to its inoperative position away from the drum 1, as shown in FIGS. 8 and 9. Subsequently, the second latent image for an M toner image is formed on the drum 1 in an image forming area M1 further upstream of the previously stated area Z with respect to the direction of rotation of the drum 1.

In the illustrative embodiment, before the leading edge M2 of the above image forming area M1 reaches the second cleaning roller 10M, the roller 10M is brought into contact with the drum 1. On the arrival of the edge M2 at the cleaning roller 10Y, the roller 10Y is released from the drum 1, as shown in FIG. 8. Such a timing can be suitably set. The area M1 is discharged by the discharge lamp 11. When the edge M2 of the area M1 reaches the charge roller 2, the roller 2 is caused to contact the drum 1, as shown in FIG. 9. In this position, the charge roller 2 charges the area M1 to the negative polarity. Then, the laser beam L scans the charged area M1.

The latent image formed on the drum 1 by the above procedure is developed by the second developing unit 4M and turns out an M toner image. This is exactly the same as with the previously stated Y toner image. After the transfer of the M toner image from the drum 1 to the paper over the Y toner image, the second cleaning roller 10M brought to its operative position collects the M toner remaining on the drum 1. Thereafter, the collected M toner is redeposited on the nonimage forming area of the drum 1 upstream of the area M1, and then collected by the developing unit 4M to be reused thereby.

The above procedure is repeated to sequentially transfer a C and a B toner image to the paper over the composite image existing on the paper. At this instant, the third and fourth cleaning rollers 10C and 10D sequentially collect the C toner and B toner remaining on the drum 1. The collected C toner and B toner are conveyed by the drum 1 to the developing units 4C and 4B, respectively. In any case, the toner of each color is returned to the developing unit storing the developer of the same color as the toner. This obviates the mixture of colors and allows each collected toner to be reused without deteriorating the quality of toner images to be formed on the drum 1.

There are also shown in FIG. 1 power sources $ME_2$, $CE_2$, $BE_2$, $ME_5$, $CE_5$ and $BE_5$ similar to the power sources $YE_2$ and $YE_5$ and assigned to the developing units 4M–4B. There are further shown power sources $ME_3$, $CE_3$, $BE_3$, $ME_4$, $CE_4$ and $BE_4$ similar to the power source $YE_3$ and $YE_4$ and assigned to the cleaning rollers 10M, 20C and 10B.

The toner collected by any one of the cleaning rollers 10Y–10B is redeposited on the non-image forming area of the drum 1, as stated above. Therefore, the collected toner does not effect the next latent image or the resulting toner image, not to speak of the latent image formed in the image forming area. If desired, the collected toner may be deposited on the trailing portion of the associated image forming area.

Control means is provided for controlling the rotation of each cleaning roller and the voltage to be applied to the cleaning roller as well as the operation of each developing unit, so that the above operation for toner collection is performed.

The toner $T_1$ remaining on the drum 1 moved away from the image transfer position 8 contains particles of polarity opposite to the polarity deposited on the toner at the time of development, as stated earlier. In the illustrative embodiment, such particles of opposite polarity are regulated to the original polarity by friction acting between the drum 1 and the cleaning rollers 10Y–10B. In practice, however, it is difficult to fully regulate the polarity of the residual toner existing at the nip N shown in FIG. 2. That is, the particles of opposite polarity still exist at the nip N although small in amount.

Specifically, when any one of the cleaning rollers 10Y–10B collects the associated toner remaining on the drum 1, a voltage of polarity opposite to the polarity deposited on the toner at the time of development is applied to the cleaning roller, as stated previously. As a result, the toner is electrostatically transferred from the drum 1 to the cleaning roller. At this instant, even the toner of polarity opposite to the above original polarity deposits on the cleaning roller due to the mechanical scraping force of the roller. Should such toner of opposite polarity be returned to the drum 1 during collection, it would contaminate the background of an image and would smear the charge roller 2.

In light of the above, as shown in FIG. 2, the cleaning roller 10Y, for example, is caused to rotate at the time of collection such that its surface moves in the opposite direction to the surface of the drum 1, as seen at the nip N. In addition, the rotation of the roller 10Y is controlled such that it collects the toner from the drum 1 before it completes one full rotation. As a result, the toner collected by the roller 10Y does not contact the drum 1 again during collection. Further, the toner of opposite polarity collected by the roller 10Y is prevented from being electrostatically transferred to the cleaned surface of the drum 1 during collection. The other cleaning rollers 10M, 10C and 10B are controlled in exactly the same manner as the cleaning roller 10Y by the control means.

Assume that the cleaning roller 10Y rotates in the direction indicated by a dash-and-dots arrow b in FIG. 2. Then, the surface of the roller 10Y and that of the drum 1 move in the same direction, as seen at the nip N. At this time, the collected toner, labeled $T_4$, exists on the downstream side of the roller 10Y with respect to the direction of rotation of the drum 1. Assume that the toner $T_4$ is of positive polarity, i.e., opposite polarity. Then, the positive voltage applied to the roller 10Y at the time of collection electrostatically attracts the toner $T_4$ toward the drum 1, causing it to deposit on the drum 1. As a result, the toner $T_4$ contaminates the background of the next toner image to be formed on the drum 1. This is why the cleaning rollers 10Y–10B each moves in a direction a opposite to the direction of movement of the drum 1, as seen at the nip N.

Further, assume that the cleaning rollers 10Y–10B collects the toner from the drum 1 by performing one or more rotations. Then, if the toner $T_4$ of opposite polarity exists in the collected toner, it is again brought toward the drum 1 by the cleaning roller and deposited thereon. This is why the cleaning roller performs only less than one rotation, as stated earlier.

The above configuration allows a minimum of toner of polarity opposite to the polarity deposited at the time of development to be transferred to the drum 1.

The cleaning rollers 10Y–10B may each be rotated in any direction when it returns the collected toner to the drum 1. In the illustrative embodiment, each cleaning roller moves in the same direction (indicated by the arrow b in FIG. 2) as the drum 1, as seen at the nip N. In addition, each cleaning roller rotates at a higher speed during the return of the toner than during the collection of the same, and rotates at a higher peripheral speed than the drum 1. As a result, the toner can be efficiently redeposited on the drum 1 within a short period of time.

Figure 11:
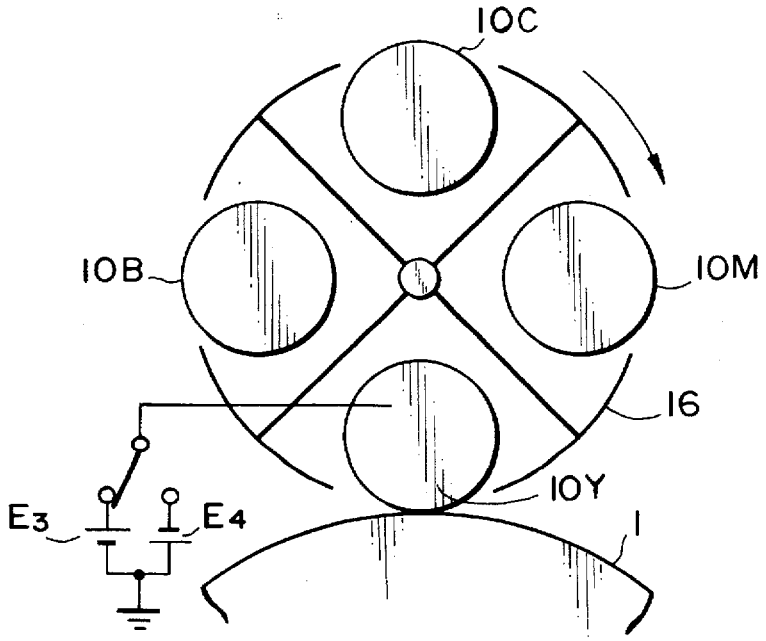
FIG. 11 shows an alternative embodiment of the present invention in which a plurality of cleaning rollers are mounted on a single roll body.

In the construction shown in FIG. 1, the cleaning rollers 10Y–10B are sequentially arranged along the periphery of the drum 1, and each electrostatically collects the toner from the drum 1 and returns it to the drum 1. Such an arrangement simplifies a mechanism for supporting the rollers 10Y–10B or a mechanism for moving them into and out of contact with the drum 1. However, this kind of arrangement prevents the drum 1 from being reduced in size. FIG. 11 shows an alternative embodiment of the present invention which is a solution to this problem.

As shown in FIG. 11, the leaning rollers 10Y–10B are supported by a single rotary body 16 and spaced from each other in the circumferential direction of the body 16. Rotary body drive means, not shown, rotates the rotary body 16 such that one of the rollers 10Y–10B expected to collect or redeposit the toner is brought to an operating position facing the drum 1. In FIG. 11, the roller 10Y is shown as being located at the operating position by way of example. In this condition, the power source $E_3$ or $E_4$ applies the voltage to the roller 10Y in the previously stated manner, causing the roller 10Y to collect or redeposit the toner. As for the rest of the construction, this embodiment is identical with the previous embodiment. With this configuration, it is possible to reduce the diameter, i.e., size of the drum 1 because the roller 10Y–10B are not arranged along the periphery of the drum 1.

Figure 12:
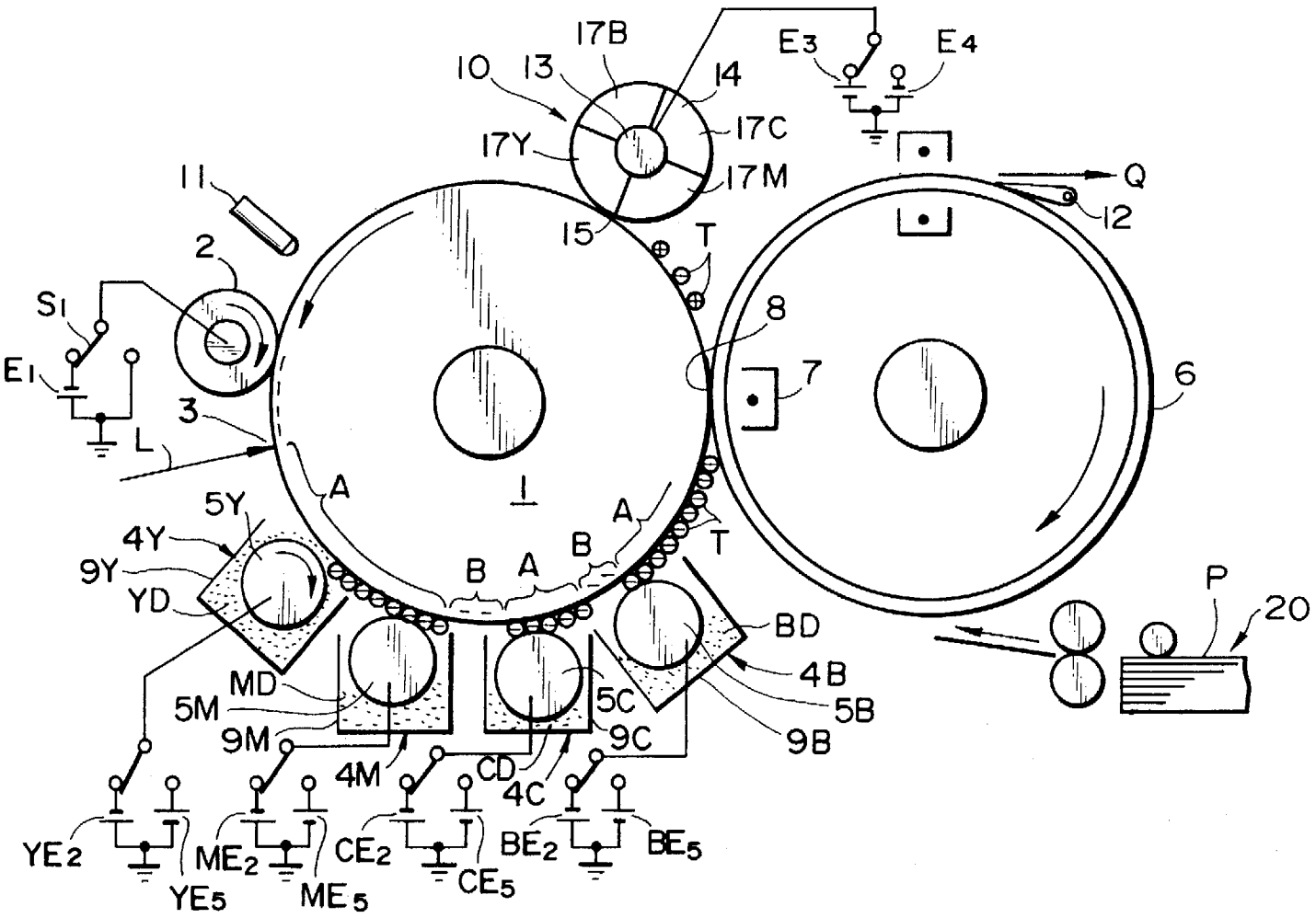
FIG. 12 shows another alternative embodiment of the present invention in which a single cleaning roller collects toner from a photoconductive element and redeposits it on the photoconductive element.

The problem with a plurality of cleaning rollers 10Y–10B each collecting the toner of particular color is that they increase the overall size and cost of the image forming apparatus. FIG. 12 shows another alternative embodiment of the present invention capable of eliminating this problem.

As shown in FIG. 12, a single cleaning roller 10 is used to collect the toner of different colors from the drum 1 and returns them to the drum 1. As for the basic construction, the apparatus shown in FIG. 12 is identical with the apparatus shown in FIG. 1. The cleaning roller 10 is located downstream of the image transfer position 8, but upstream of the charge roller 2, in the direction of rotation of the drum 1. The roller 10 is also made up of the conductive shaft 13 and elastic body 14. in the illustrative embodiment, the circumference of the roller 10 is divided into regions corresponding in number to the toner of different colors, i.e., four regions 17Y, 17M, 17C and 17B. The regions 17Y–17B each collects the toner of particular color from the drum 1, as follows.

Figure 13:
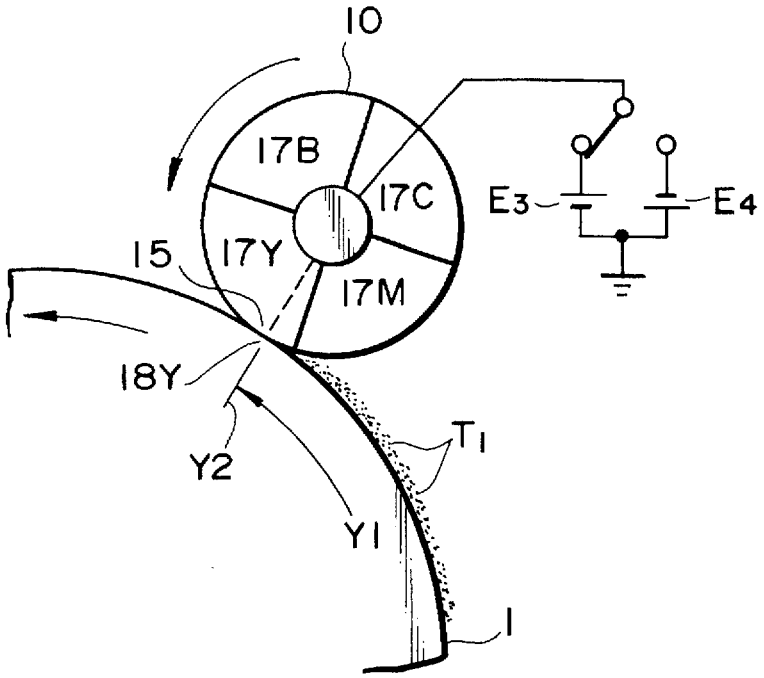
FIGS. 13–21 each shows various members included in the embodiment shown in FIG. 12 at a particular stage of operation.

FIG. 13 shows a condition wherein the leading edge Y2 of the Y toner image forming region Y1 moved away from the image transfer position 8, FIG. 6, has arrived at the cleaning position 15 by way of example. As shown, a portion 18Y included in the toner collecting region 17Y contacts the drum 1. The cleaning roller 1 is rotated counterclockwise at a relatively low speed. A power source $E_3$ applies a positive voltage opposite in polarity to the toner $T_1$ left on the drum 1 to the shaft 13 of the roller 10. While the drum 1 and roller 10 move in opposite directions to each other, as seen at their nip, the region 17T of the roller 10Y electrostatically collect the toner $T_1$ from the image forming area Y1.

Figure 14:
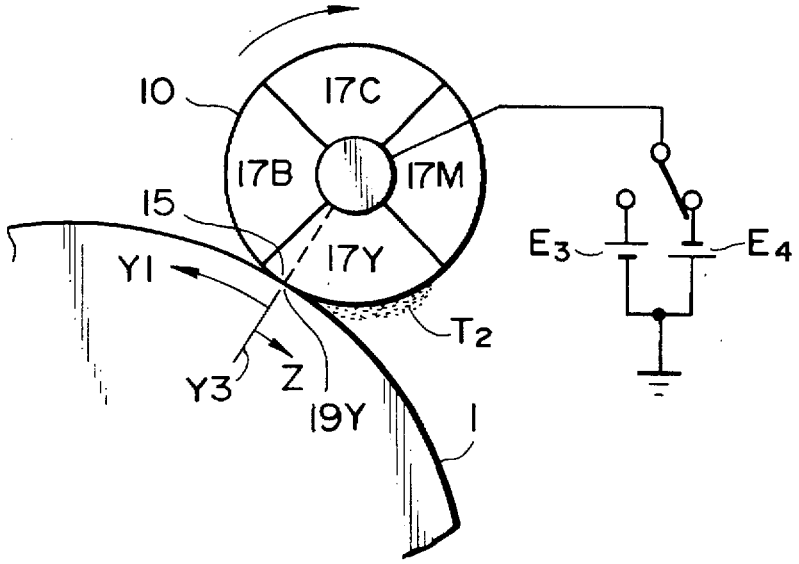

FIG. 14 shows a condition wherein the trailing edge Y3 of the Y image forming area Y1 has arrived at the cleaning position 15. As shown, a portion 19Y included in the region 17Y contacts the drum 1. At this time, the cleaning roller 10 completes the collection of the toner $T_1$ from the area Y1 of the drum 1, i.e., ends the cleaning operation. Subsequently, the power source $E_4$ applies a negative voltage identical in polarity to the toner to the roller 10, as in the previous embodiment. In addition, the rotation of the roller 10 is reversed, i.e., the roller 10 is caused to move in the same direction as the drum 1 at the nip. As a result, the toner collected by the region 17Y of the roller 10 is redeposited on the non-image forming area Z of the drum 1. During redeposition, the roller 10 is rotated at a higher speed than during collection.

Figure 15:
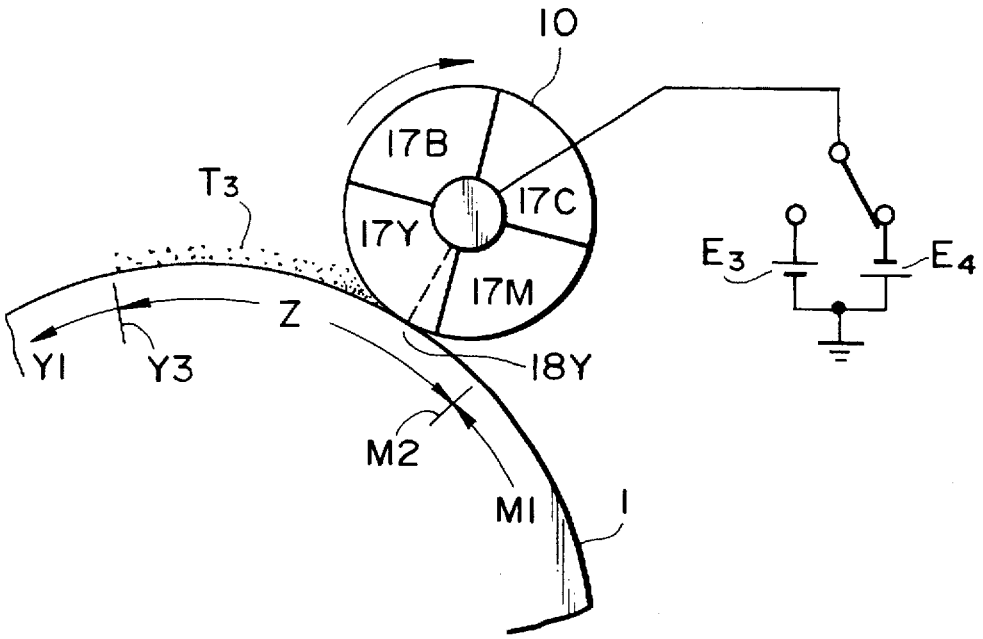

FIG. 15 shows a condition wherein the portion 18Y of the region 17Y has reached the drum 1 and fully returned the toner to the drum 1. The Y toner $T_3$ redeposited on the nonimage forming area Z of the drum 1 is conveyed to the developing unit 4Y, FIG. 12, by the drum 1. The developing unit 4Y electrostatically collects the tone $T_3$ from the drum in exactly the same manner as in the previous embodiment. In FIG. 15, an image forming area forming an M toner image is labeled M1 although the M toner image has not been formed yet.

Figure 16:
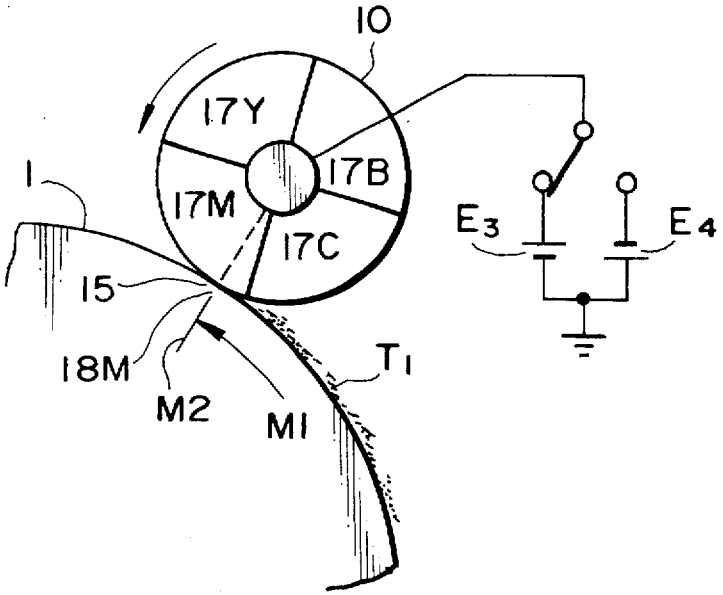

As stated above, after the redeposition of the toner on the drum 1, the positive voltage is applied to the cleaning roller 10 from the power source $E_4$. The roller 10 is continuously rotated clockwise, as viewed in FIG. 15. As shown in FIG. 16, when a portion 18M included in the next region 17M of the roller 10 contacts the drum 1, the roller 10 is brought to a stop.

When the leading edge M2 of the M toner image forming area M1 arrives at the charge roller 2, FIG. 12, the charge roller 2 is brought into contact with the drum 1 in order to charge the area M1 uniformly to the negative polarity. Then, the laser beam L scans the charged area M1 in order to form a latent image thereon. The developing device 4M develops the latent image so as to form a corresponding M toner image. When the leading edge M2 of the area M1 arrives at the cleaning position 15, FIG. 16, the cleaning roller 10 is rotated counterclockwise. As a result, the M toner remaining on the drum 1 after the image transfer is collected by the region 17M of the roller 10 in exactly the same manner as the Y toner is collected by the region 17Y. Subsequently, the collected M toner is redeposited on a non-image forming area following the trailing edge of the M image forming area with respect to the direction of rotation of the drum 1 and not effecting the next image formation. The developing unit 4M electrostatically collects the M toner from the drum 11 and reuses it.

The above procedure is repeated to cause the regions 17C and 17B of the cleaning roller 10 to sequentially collect the C toner and B toner left on the drum 1. The collected C toner and B toner are respectively collected and reused by the developing units 4C and 4B.

In the embodiment shown in FIGS. 1–11, every time a toner image of one color is formed on the drum and then transferred to a paper, one of the cleaning rollers 10Y–10B assigned to the above color collects the toner remaining on the drum 1 and then redeposits it on the drum 1. Specifically, the rotation of each cleaning roller and the voltage to be applied to the roller are controlled such that after the collection of the toner, the individual roller redeposits the toner on the drum 1, and the associated developing unit electrostatically collects the toner. With this configuration, it is possible to return the collected toner to the drum 1 within a short period of time. i.e., before the charge deposited on the collected toner decreases. This successfully increases the redeposition efficiency of the toner on the drum 1.

However, as FIGS. 4–9 indicate, the toner collected by any one of the cleaning rollers 10Y–10B is redeposited on the non-image forming area Z following the trailing edge of the toner image forming area with respect to the direction of rotation of the drum 1. Therefore, it is necessary to start forming a latent image for the next toner image at a position on the drum 1 further rearward of the portion where the toner has been redeposited. Consequently, a broad non-toner image forming area intervenes between the consecutive toner image forming areas in the circumferential direction of the drum 1, lowering the image forming speed.

In light of the above, during each color image forming operation, the collection of the residual toner by the cleaning roller and the redeposition of the collection toner on the drum 1 are executed. In addition, after all the toner left on the drum 1 during the image forming operation have been collected by the cleaning rollers 10Y–10B, they are redeposited on the drum 1 independently of each other and collected by the associated developing units. This kind of procedure increases the image forming speed and can be done by controlling the rotation of the rollers 10Y–10B and the voltage application the rollers 10Y–10B.

For example, after the cleaning roller 10Y has collected the Y residual toner from the drum 1 in its operative position shown in FIG. 1, it is released from the drum 1 without returning the toner to the drum 1. Then, the cleaning roller 10M is brought to its operative position to collect the M residual toner from the drum 1. The roller 10M collected the toner is also released from the drum 1 without redepositing it on the drum 1. Likewise, the cleaning rollers 10C and 10B collected the C and B residual toner, respectively, are sequentially released from the drum 1 without redepositing them on the drum 1.

After all the cleaning rollers 10Y–10B have collected the toner of associated colors, they sequentially return the toner to the drum 1 while, e.g., a paper wrapped around the transfer drum 6 is using separated from the drum 6 or while a new sheet is being wrapped around the drum 6. For example, while the paper is being separated from the drum 6, the roller 10Y is brought to its operative position contacting the drum 1 and rotated clockwise, as viewed in FIG. 1. The power source $YE_4$ applies the negative voltage to the roller 10Y in order to cause it to return the collected Y toner to the drum 1. The Y toner toner is collected by the developing unit 4Y. Subsequently, the roller 10Y is moved to its inoperative position away from the drum 1 while the next roller 10M is brought into contact with the drum 1. The roller 10M redeposits the collected M toner on the drum 1 in exactly the same manner as the roller 10Y. The M toner deposits on the drum at the rear (downstream) of the Y toner in the direction of rotation of the drum 1. The M toner is collected by the developing unit 4M. This is also true with the other rollers 10C and 10B.

Figure 17:
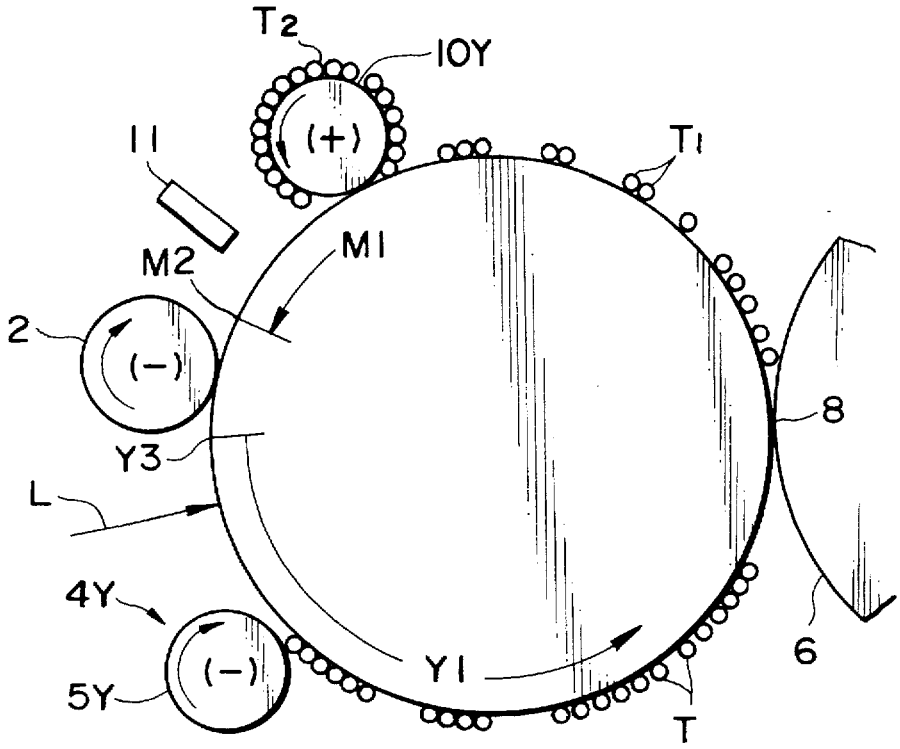

The above alternative procedure makes it needless to redeposit the toner $T_3$ on the non-image forming area Z shown in FIG. 8. It is therefore possible to reduce the non-image forming area intervening between the consecutive image forming areas Y1 and M1 as far as possible or even to practically eliminate the non-image forming area. This increases the overall image forming speed. FIG. 17 shows a condition wherein the cleaning roller 10Y has fully collected the residual Y toner from the Y toner image forming area Y1 of the drum 1. As shown, the alternative procedure allows a latent image to be formed on the drum 1 just upstream of the trailing edge Y3 of the Y toner image forming area Y1, so that the distance between consecutive images can be noticeably reduced. In addition, because the redeposition of the toner on the drum 1 can be effected during, e.g., the separation of the paper from the transfer drum 6, the redeposition does not lower the image forming speed.

With the embodiment shown in FIGS. 13–16, it is also possible to redeposit the toner collected by the consecutive regions 17Y–17B of the cleaning roller 10 on the drum 1 within a short period of time, i.e., before the charge deposited on the toner decreases. As a result, the toner can be efficiently redeposited on the drum 1. However, as FIG. 15 indicates, a broad non-image forming area for the redeposition of the toner T3 must be provided at the rear of the trailing edge of the image forming area in the direction of rotation of the drum 1. This is likely to lower the image forming speed. To solve this problem, the redeposition procedure shown in FIGS. 13–16 may be slightly varied such that after the roller 10 has collected all the toner of different colors, it returns them to the drum 1, as will be described with reference to FIGS. 18–20.

Figure 18:
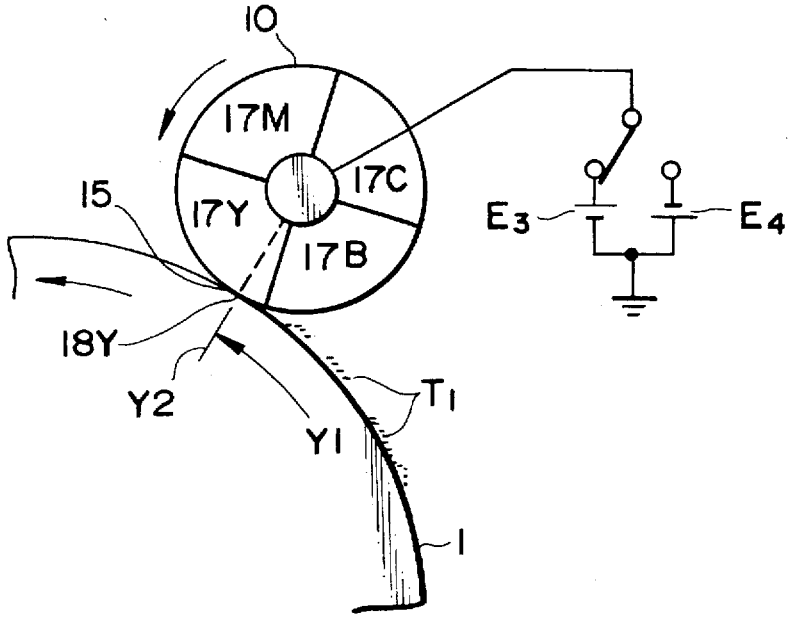

As shown in FIG. 18, assume that while portion 18Y of the region 17Y of the cleaning roller 10 is in contact with the drum 1, the leading edge Y2 of the Y toner image forming area moved away from the image transfer position has reached the cleaning position 15. Then, the power source $E_3$ applies a positive voltage to the roller 10, and the roller 10 is caused to rotate counterclockwise. As a result, the region 17Y of the roller 10 collects the Y toner $T_1$ remaining on the image forming area Y1.

Figure 19:
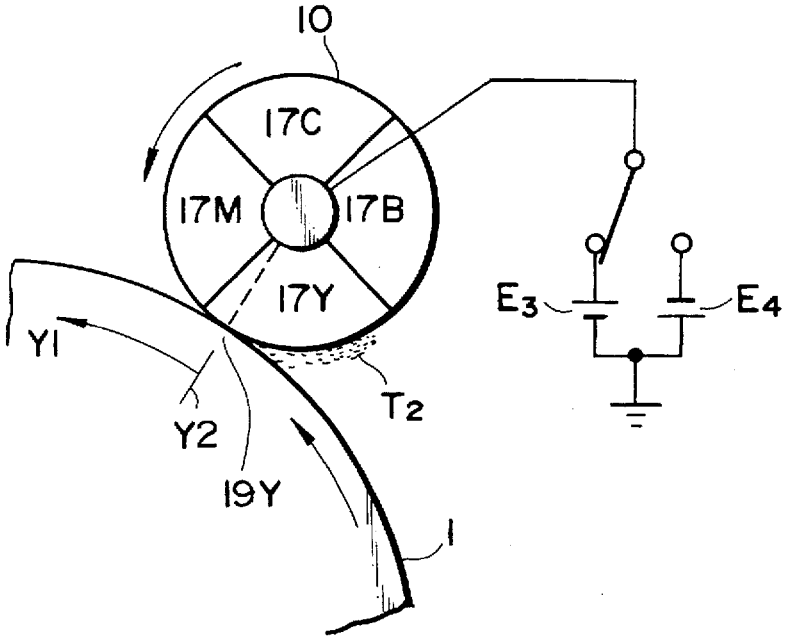
Figure 20:
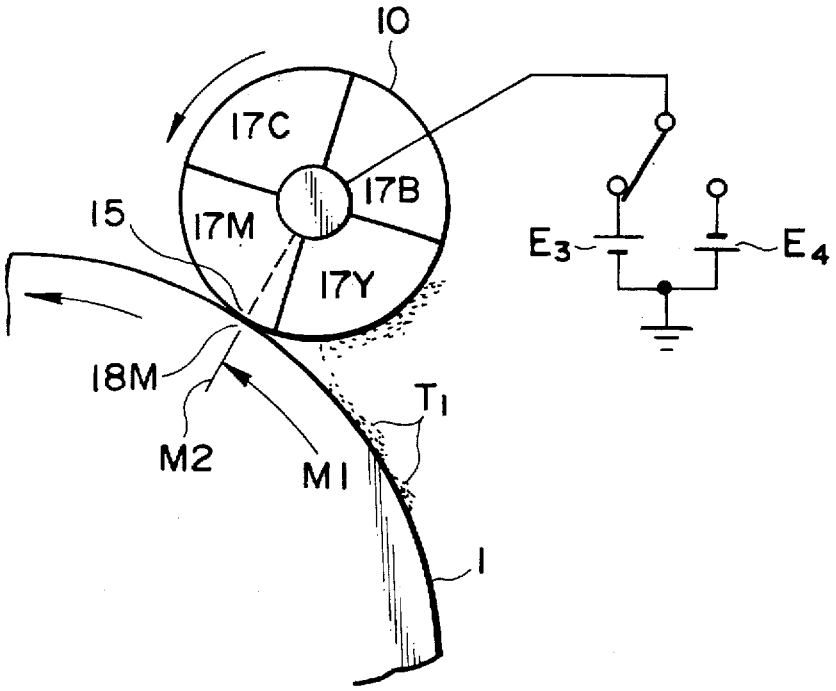

FIG. 19 shows a condition wherein the region 17Y of the roller 10 has fully collected the Y toner $T_1$. At this time, the portion 19Y of the region 17Y contacts the drum 1. The roller 10 holds the Y toner $T_1$ thereon without returning it to the drum 1. Subsequently, as shown in FIG. 20, the roller 10 is slightly rotated counterclockwise until the portion 18M of the next region 17M contacts the drum 1. The positive voltage is continuously applied to the roller 10. Consequently, the region 17M starts collecting the residual M toner at the time when the leading edge M2 of the M image forming area M1 undergone image transfer arrives at the cleaning position 15.

Figure 21:
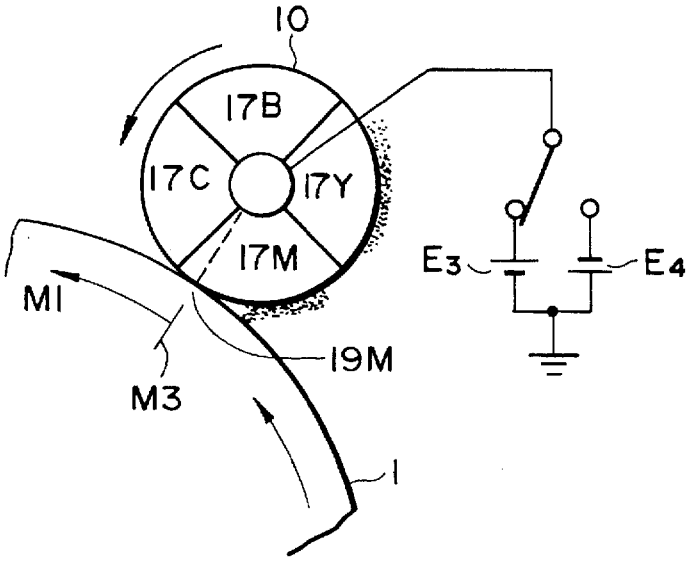

FIG. 21 shows a condition wherein the region 17M of the roller 10 has fully collected the M toner from the drum 1. At this instant, the portion 19M of the region 17M contacts the drum 1. Again, the roller 10 holds the collected M toner thereon. The regions 17C and 17B of the roller 10 sequentially collect and hold the C toner and B toner in exactly the same manner as the above regions 17Y and 17M.

As stated above, the embodiment reduces the non-image forming area between the image forming areas as far as possible or even eliminates it because the embodiment does not redeposit any toner on the non-image forming area following the trailing edge of the image forming area.

After the cleaning roller 10 has collected all the toner of different colors, it sequentially returns them to the drum 1. This can be done by using, e.g., the period of time during while the paper is separated from the transfer drum 6, FIG. 12. For example, after the roller 10 has been brought to the position shown in FIG. 18, the power source $E_4$ applies a negative voltage to the roller 10. At the same time, the roller 10 is rotated counterclockwise while redepositing the toner collected by the region 17Y on the drum 1. The toner redeposited on the drum 1 is electrostatically collected by the developing unit 4Y. Subsequently, the roller 10 is moved to the position shown in FIG. 10, applied with the negative voltage, and then rotated counterclockwise. As a result, the toner is returned from the region 17M of the roller 10 to the drum 1 and then collected by the developing unit 4M. This is also true with the other regions 17C and 17B of the roller 10.

Because the redeposition described above occurs during, e.g., the separation of the paper from the transfer drum 6, it does not lower the image forming speed.

In the embodiments shown in FIGS. 13–16 and 18–21, the toner collected by each of the regions 17–17B is not deposited over the entire area of the region, but deposited only on the intermediate portion (e.g. from the portion 18Y to the portion 19Y in the case of the region 17Y). Should the collected toner extend as far as the boundary between the adjoining regions, it might be mixed with the toner of other colors. Only if such mixture of colors does not occur or occurs little, the toner may deposit over the entire area of each of the regions 17Y–17B.

In the embodiment shown in FIGS. 18–21, every time a color image forming operation completes, the cleaning roller 10 returns the collected toner to the drum 1. Alternatively, the cleaning roller may not redeposit the collected toner until the color image forming operation has been repeated a plurality of times, although collecting the toner each time. In this case, the roller returns the collected toner to the drum 1 after the color image forming operation has been repeated a plurality of times. With this procedure, it is possible to further increase the image forming speed.

For example, the embodiment described with reference to FIG. 1 may be modified, as follows. After the cleaning roller 10Y has collected the residual Y toner from the drum 1 in its operative position, it is moved to its inoperative position without redepositing the toner on the drum 1. Subsequently, the cleaning roller 10M is brought to its operative position in order to collect the residual M toner from the drum 1. The roller 10M is also moved to its inoperative position without returning the M toner to the drum 1. Likewise, the cleaning rollers 10C and 10B sequentially collect the C toner and B toner and do not return them to the drum 1 at this stage of operation. While the previous embodiment causes the rollers 10Y–10B to sequentially return the collected toner to the drum 1 every time a single image forming operation ends, the modification causes the rollers 10Y–10B to hold the collected toner after every image forming operation.

After the above image forming operation has been repeated a plurality of times, the cleaning rollers 10Y–10B sequentially redeposit the collected toner on the drum 1. The toner is redeposited on the drum 1 and then collected by the associated developing unit in exactly the same manner as in the previous embodiment. In this case, the cleaning rollers 10Y–10B may each perform a plurality of rotations while collecting the residual toner each time.

The embodiment shown in FIGS. 18–21 may also be modified such that the cleaning roller 10 returns the collected toner of different colors after the image forming operation has been repeated a plurality of times. The prerequisite it this modification is that the toner sequentially depositing on the roller 10 in layers be not excessive in amount; otherwise, the collection efficiency would be lowered. The roller 10 is therefore caused to return the collected toner to the drum 1 when the image forming operation is repeated a particular number of times which does not lower the collection efficiency, as follows.

In each of the above image forming procedures, the cleaning member or members do not return the collected toner to the drum or image carrier 1 until the image forming operation has been repeated it consecutive times (n being 2 or greater integer). After the n times of image formation, the cleaning member or members each returns the respective toner to the drum 1.

The method described with reference to FIGS. 18–21 and redepositing the toner every time a color image forming operation is repeated a plurality of times may be generalized, as follows. A toner collecting area available with a cleaning member is divided into collecting regions each being assigned to a particular color. The cleaning member collects residual toner of particular color with each collecting region every time a color image forming operation is performed. The cleaning member does not redeposit the collected toner on an image carrier until he color image forming operation has been repeated n consecutive times. On fully collecting the residual toner resulting from the n times of image formation, the cleaning member sequentially redeposits the collected color on the image carrier from its collecting regions. The toner redeposited on the image carrier is collected by the associated developing unit.

Figure 22:
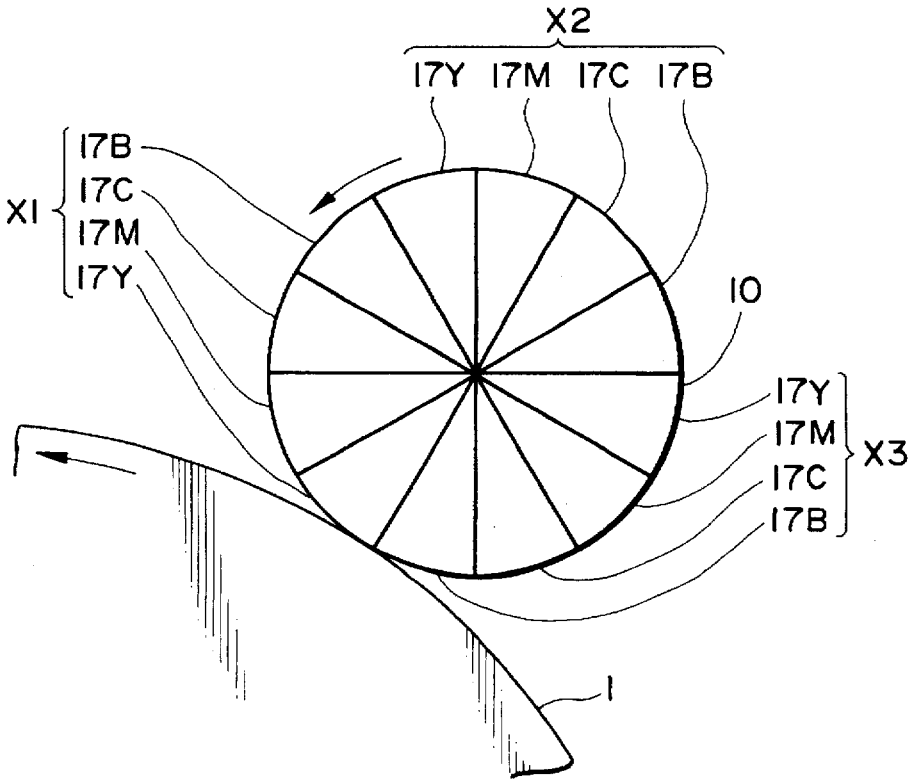
FIGS. 22 and 23 each shows another specific configuration of the cleaning roller included in the embodiment of FIG. 12.

FIG. 22 shows another alternative embodiment of the present invention. As shown, the circumference of the cleaning roller 10 is divided into a plurality of groups X1, X2 and X3 each having the toner collecting regions 17Y–17B and adjoining each other. Every time a color image forming operation completes, one of the groups X1–X3 is used to collect the remaining toner of different colors from the drum 1. After the image forming operation has been repeated a number of time corresponding to the number of groups X1–X3, i.e., three times in the embodiment, the roller 10 sequentially returns collected toner to the drum 1. The toner redeposited on the drum 1 is electrostatically collected by the associated developing unit.

Specifically, while the roller 10 is rotated counterclockwise at a low speed, the region 17Y of the first group X1 collects the residual Y toner from the drum 1, but does not return it to the drum 1, as stated earlier. Next, the region 17M of the first group X1 collects the residual M toner from the drum 1, but does not return it to the drum 1. In this manner, the roller 10 collects, with the first group of regions X1, the toner of four different colors left on the drum 1 during the first color image forming operation. After the first image forming operation, the roller 10 is brought to a stop while holding the toner thereon.

Subsequently, during the second color image forming operation, the roller 10 is rotated counterclockwise while collecting the residual toner of different colors with the second group X2 having the consecutive collecting regions 17Y–17B. After the color image forming operation has been repeated three consecutive times, the roller 10 returns the collected toner of different colors to the drum 1 one by one. Specifically, the roller 10 returns the Y toner from the region 17Y of the first group X1 first. The returned Y toner is collected by the Y developing unit 4Y, FIG. 12. Then, the roller 10 returns the M toner from the region 17M of the first group X1 to the drum. The M toner is collected by the M developing unit 4M. The roller 10 repeats such toner redeposition.

In the above procedure, the cleaning roller 10 does not redeposit the collected toner on the drum 1 until the color image forming operation has been repeated three consecutive times. This reduces the distance between consecutive image forming areas and thereby increase the image forming speed. In addition, because the roller 10 should only be rotated in one direction during toner collection, control over the roller 10 is simplified.

While the cleaning roller 10 shown in FIG. 22 has three groups of toner collecting regions, it may be provided with any other suitable number of groups. Of course, the number of colors for color image formation is not limited to four.

The image forming method shown in FIG. 22 may be generalized, as follows. Assume that the number of colors of toner is m, and that the colors are a first color to an m-th color. Then, a first to an m-th toner collecting region adjoining each other are set on a cleaning member in the circumferential direction of the cleaning member. Assuming that n is 2 or greater integer, the first to m-th toner collecting regions are set in n consecutive groups in the circumferential direction of the cleaning member. The toner collecting regions of each group respectively collect residual toner of different colors resulting from a single color image forming operation. The cleaning member does not redeposit the collected toner on an image carrier until the color image forming operation has been repeated n consecutive times. On fully collecting the residual toner resulting from the n times of color image formation, the cleaning member redeposits the collected toner on the image carrier from the individual toner collecting region The toner of different colors redeposited on the image carrier are each collected by a particular developing unit storing a developer of the same color. In FIG. 22, m and n are selected to be 4 and 3, respectively.

Figure 23:
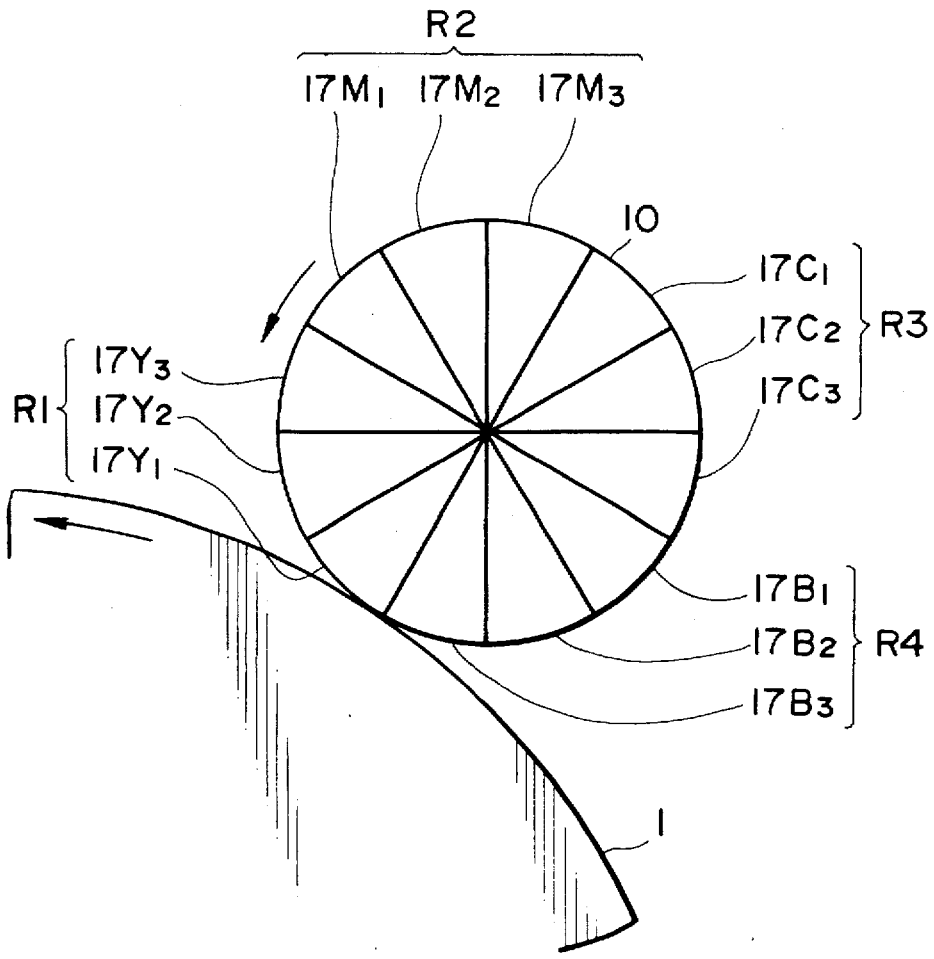

FIG. 23 shows a further alternative embodiment of the present invention. As shown, the circumference of the cleaning roller 10 is divided into a plurality of groups of regions R1, R2, R3 and R4. The groups R1–R4 are respectively subdivided into toner collecting regions 17Y1–17Y3, 17M1–17M3, 17C1–17C3 and 17B1–17B2 each being assigned to a particular color.

In operation, while the cleaning roller 10 is rotated counterclockwise at a low speed, the region 17Y1 of the group R1 electrostatically collects the residual Y toner first. Then, the roller 10 is rotated counterclockwise before the residual M toner reaches the roller 10, causing the region 17M1 of the group R2 to contact the drum 1. The region 17M1 electrostatically collects the residual M toner. Next, the roller 10 is rotated counterclockwise to cause the region 17C1 of the group R3 to electrostatically collect the residual C toner. In the same manner, the region 17B1 of the group 4 electrostatically collects the B residual toner. In this manner, the first color image forming operation ends. At this stage of operation, the roller 10 does not return the collected toner to the drum 1.

During the next color image forming operation, the region 17Y2 of the group R1 collects the residual Y toner first. Then, the roller 10 is rotated counterclockwise to cause the region 17M2 of the group R2 to collect the residual M toner. This is repeated with the region 17C2 of the group R3 and the region 17B2 of the group R4. When the color image forming operation is repeated a plurality of times, the Y, M, C and B toner are respectively deposited on the entire surfaces of the groups R1–R4. On the end of the laster color image formation, the roller 10 is rotated in a suitable direction in order to sequentially redeposit the toner of different colors on the drum 1. Again, the redeposited toner of different colors are each collected by the associated developing unit. For example, while the roller 10 is in rotation, the Y toner is returned from the group R1 to the drum 1 and then collected by the Y developing unit 4Y. Then, the M toner is returned from the group R2 to the drum 1 and then collected by the M developing unit 4M. The C and B toner are sequentially dealt with in the same manner as the Y and M toner. This kind of procedure also increases the image forming speed and allows the collected toner to be redeposited on the drum 1 within a short period of time.

The above procedure may be generalized, as follows. Assume that n is 2 or greater integer, that the number of colors is m, and that the colors are a first color to an m-th color. Then, n toner collecting regions adjoining each other are set on a cleaning member in the circumferential direction of the cleaning member and assigned to toner of particular color. The n toner collecting regions are provided in m groups on the cleaning member in the circumferential direction of the cleaning member. The toner collecting regions of each group sequentially collect the residual toner of the same color resulting from repeated color image forming operation. The cleaning member does not return the collected toner to an image carrier until the color image forming operation has been repeated n consecutive times. On fully collecting the toner of different colors resulting from the n times of image formation, the cleaning member returns the toner of different colors to the image carrier from the consecutive groups of collecting regions. The toner of different colors are each collected by the respective developing unit. In FIG. 23, m and n are assumed to be 4 and 3, respectively.

In the embodiments of the kind using a single cleaning roller 10 having a plurality of collecting regions or a plurality of groups of collecting regions, the collected toner of certain color is redeposited on the drum 1 first an then collected by the developing unit storing the developer of the same color. Subsequently, the collected toner of another color is redeposited on the drum 1 and collected by the associated developing unit. The prerequisite with such embodiments is that when any one of the developing units collects the respective toner, the other developing units remain inoperative. For example, when the M toner redeposited on the drum and to be collected by the developing unit 4M is conveyed toward the developing unit 4M by the drum 1, it is necessary to space the developing rollers of the other developing units, particularly the developing roller 5Y of the developing unit 4Y, from the drum 1 or bring its developer to an inoperative position. Therefore, the developing unit expected to collect the toner must prepare for the collection while the other developing units must set up the inoperative condition. A certain period of time is necessary for such preparation to be completed. Assume that the drum 1 conveys the redeposited M toner immediately after the redeposited Y toner. Then, it may occur that before the developing unit 4Y collected the Y toner becomes inoperative, the M toner is brought to the unit 4Y and introduced into the Y toner existing in the unit 4Y.

To obviate the mixture of colors ascribable to the above occurrence, it is preferable that after the collected toner of certain color has been redeposited on the drum 1, the rotation of the cleaning member is interrupted for a preselected period of time before redepositing the collected toner of another color on the drum 1. For example, in FIG. 23, after the cleaning roller 10 has been rotated to return the collected toner from the group of collecting regions R1 to the drum 1, it is brought to a stop. Then, on the elapse of a preselected period of time, the roller 10 is again rotated to return the toner from the next group of collecting regions to the drum 1. This allows the consecutive toner redeposited on the drum to be spaced by a desired distance in the circumferential direction of the drum 1. As a result, each toner can be successfully collected in the associated developing unit without being mixed with other toner.

The above distance between the consecutive toner on the drum is also achievable if each collecting region of the roller 10 holds the collected toner only in its intermediate portion in the circumferential direction of the roller, as stated with reference to FIGS. 13–16. In this case, it may be needless for the roller 10 to be stopped after the redeposition of each collected toner.

In summary, it will be seen that a method and an apparatus for color image formation of the present invention have various unprecedented advantages, as enumerated below.

(1) With a simple construction, it is possible to return toner of any color left on an image carrier after image transfer to a developing section storing a developer of the same color as the toner. This allows the toner to be reused while being prevented from being mixed with toner of other colors.

(2) An arrangement for supporting cleaning members is simplified. This reduces the cost of the image forming apparatus.

(3) A rotary body carrying a plurality of cleaning members thereon prevents the image carrier from being increased in size.

(4) In addition to the above advantage (1), there can be effected, with a single cleaning member, the collection of the toner from the image carrier and the redeposition of the collected toner on the image carrier.

(5) The toner collected by the cleaning member is returned to the image carrier within a short period of time. Therefore, the toner can be redeposited before its charge decreases, and therefore with high redeposition efficiency.

(6) After all the toner of different colors have been collected during image forming operation, they are sequentially returned to the image carrier. This successfully increases the image forming speed.

(7) The toner collected on the cleaning member is redeposited on the image carrier after the image forming operation has been repeated a plurality of consecutive times. This further increases the image forming speed.

(8) The above advantage (7) is achievable with a single cleaning member, so that the apparatus is simplified in construction. There are also simplified the collection of the toner by the cleaning member and the redeposition of the collected toner on the image carrier.

(9) The toner of different colors are prevented from being mixed together in the developing devices.

Various modifications will become possible for those skilled in the art after receiving the teachings of the present disclosure without departing from the scope thereof. For example, while the illustrative embodiments have concentrated on a cleaning member in the form of a roller, the present invention is similarly practicable with a cleaning member implemented as an endless belt. The present invention is applicable even to an image forming apparatus using an endless belt as an image carrier. Further, the present invention is applicable to a color image forming method of the kind sequentially transferring toner images of different colors from an image carrier to an intermediate transfer body one above the other, and transferring the resulting composite image collectively to a paper or similar recording medium.

Moreover, the present invention is applicable to an image forming method of the kind charging an image carrier by a charger, causing the area of the image carrier not illuminated at the time of exposure to form a latent image, and depositing toner opposite in polarity to the latent image on the latent image, i.e., a so-called positive-to-positive development type image forming method. In addition, the present invention is practicable with a revolver having a plurality of developing sections arranged therein.

What is claimed is:

1. A color image forming method comprising the steps of:

sequentially forming toner images of different colors on an image carrier in rotation by a plurality of developing devices each storing a developer of particular color;

sequentially transferring the toner images to a single recording medium one above the other;

electrostatically collecting, after each of the toner images has been transferred to the recording medium, toner left on said image carrier by respective one of a plurality of cleaning members;

redepositing each of the toner of different colors collected by said plurality of cleaning members on a particular surface portion of said image carrier which will not effect formation of a toner image; and electrostatically collecting each of the toner of different colors redeposited on said image carrier in a particular developing device.

2. A method as claimed in claim 1, wherein said plurality of cleaning members are sequentially arranged along a circumference of said image carrier while facing said circumference.

3. A method as claimed in claim 1, wherein said plurality of cleaning members are rotatably supported by a rotary body while being spaced from each other in a circumferential direction of said rotary body, and wherein one of said plurality of cleaning members brought to an operating position facing said image carrier collects the toner from said image carrier and then redeposits the toner on said image carrier.

4. A method as claimed in claim 3, wherein collection of the toner of different colors by said plurality of cleaning members and redeposition of the toner on said image carrier are effected for every color image forming operation, and wherein after all the toner of different colors resulting from each color image forming operation have been collected, the toner of different colors collected by said plurality of cleaning members are sequentially redeposited on said image carrier, and each is collected by the respective developing device storing a developer of a same color as the toner.

5. A method as claimed in claim 4, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

6. A method as claimed in claim 3, wherein said plurality of cleaning members do not redeposit the toner on said image carrier until collecting the toner resulting from n consecutive times of color image forming operation, and then sequentially redeposit, on collecting the toner resulting from the n consecutive times of color image forming operation, the toner on said image carrier, wherein n is an integer greater than 2.

7. A method as claimed in claim 6, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

8. A method as claimed in claim 1, wherein collection of the toner of different colors by said plurality of cleaning members and redeposition of the toner on said image carrier are effected for every color image forming operation, and wherein after all the toner of different colors resulting from each color image forming operation have been collected, the toner of different colors collected by said plurality of cleaning members are sequentially redeposited on said image carrier, and each is collected by a respective developing device storing a developer of a same color as the toner.

9. A method as claimed in claim 3, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

10. A method as claimed in claim 1, wherein said plurality of cleaning members do not redeposit the toner on said image carrier until collecting the toner resulting from n consecutive times of color image forming operation, and then sequentially redeposit, on collecting the toner resulting from the n consecutive times of color image forming operation, the toner on said image carrier, wherein n is an integer greater than 2.

11. A color image forming method comprising the steps of:

sequentially forming toner images of different colors on an image carrier in rotation by a plurality of developing devices each storing a developer of particular color;

sequentially transferring the toner images to a single recording medium one above the other;

electrostatically collecting, after each of the toner images has been transferred to the recording medium, toner left on said image carrier by respective one of a plurality of toner collecting regions sequentially formed on a surface of a single cleaning member in a circumferential direction of said cleaning member;

redepositing each of the toner of different colors collected by the respective toner collecting region on a particular surface portion of said image carrier which will not effect formation of a toner image; and electrostatically collecting each of the toner of different colors redeposited on said image carrier in a plurality of cleaning members rotatably supported by a rotary body and in a particular developing device.

12. A method as claimed in claim 11, wherein after each of the toner of different colors has been collected by said respective toner collecting region, the toner is redeposited on said image carrier.

13. A method as claimed in claim 11, wherein collection of the toner of different colors by said plurality of cleaning members and redeposition of the toner on said image carrier are effected for every color image forming operation, and wherein after all the toner of different colors resulting from each color image forming operation have been collected, the toner of different colors collected by said plurality of cleaning members are sequentially redeposited on said image carrier, and each is collected by the respective developing device storing a developer of a same color as the toner.

14. A method as claimed in claim 13, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

15. A method as claimed in claim 11, wherein said plurality of cleaning members do not redeposit the toner on said image carrier until collecting the toner resulting from n consecutive times of color image forming operation, and then sequentially redeposit, on collecting the toner resulting from the n consecutive times of color image forming operation, the toner on said image carrier, wherein n is an integer greater than 2.

16. A method as claimed in claim 15, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

17. A method as claimed in claim 11, wherein assuming that the toner comprise toner of a first to an m-th color, said toner collecting regions comprise a first to an m-th toner collecting region adjoining each other for respectively collecting the toner of the first to m-th colors, wherein said first to said m-th toner collecting regions are arranged in n consecutive groups in the circumferential direction of said cleaning member, wherein said first to said m-th toner collecting regions of each of said n groups respectively collect the toner of the first to the m-th colors resulting from each image forming operation, but do not redeposit the toner on said image carrier until collecting the toner resulting from n consecutive times of color image forming operation, and then sequentially redeposit the toner on said image carrier after collecting the toner resulting from the n consecutive times of color image forming operation, wherein n and m are integers greater than 2.

18. A method as claimed in claim 17, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

19. A method as claimed in claim 11, wherein assuming that the toner of different colors comprise toner of a first to an m-th color, n toner collecting regions adjoining each other for collecting the toner of a same color are arranged on said cleaning member in m consecutive groups in the circumferential direction of said cleaning member, wherein said n toner collecting regions of said m groups sequentially collect the toner of said first to said m-th colors resulting from a color image forming operation, but do not redeposit the toner on said image carrier until collecting the toner resulting from n consecutive times of color image forming operation, and then sequentially redeposit the toner on said image carrier after collecting the toner resulting from the n consecutive times of color image forming operation, wherein n and m are integers greater 2.

20. A method as claimed in claim 19, wherein when the toner of different colors collected by said plurality of cleaning members are each redeposited on said image carrier from a particular collecting region or a particular group of collecting regions, rotation of said rotary body is interrupted for a preselected period of time between an end of redeposition and a beginning of next redeposition.

* * * * *